United States Patent [19]

Bissonette

[11] 4,088,486

[45] May 9, 1978

[54] PROCESS OF BLEACHING SILVER IMAGES TO FORM DYE IMAGES USING COBALT COMPLEXES AND PEROXIDES

[75] Inventor: Vernon L. Bissonette, Brockport, N.Y.

[73] Assignee: Eastman Kodak Company, Rochester, N.Y.

[21] Appl. No.: 731,284

[22] Filed: Oct. 12, 1976

Related U.S. Application Data

[63] Continuation-in-part of Ser. No. 602,156, Aug. 6, 1975, abandoned.

[51] Int. Cl.[2] ..... G03C 7/00; G03C 7/16; G03C 5/32; G03C 5/38

[52] U.S. Cl. ..... 96/22; 96/3; 96/29 D; 96/51; 96/54; 96/55; 96/56.5; 96/60 R; 96/60 BF; 96/61 M

[58] Field of Search ..... 96/51, 54, 55, 56.5, 96/60 R, 60 BF, 22, 3, 29 D, 61 M

[56] References Cited

U.S. PATENT DOCUMENTS

| | | | |
|---|---|---|---|
| 3,684,511 | 8/1972 | Weyde et al. | 96/48 R |
| 3,764,490 | 12/1973 | Chamber | 96/55 |
| 3,772,020 | 11/1973 | Smith | 96/60 BF |
| 3,773,510 | 11/1973 | Fisch | 96/60 BF |
| 3,776,730 | 12/1973 | Matejec et al. | 96/55 |
| 3,841,873 | 10/1974 | Mowrey et al. | 96/60 R |
| 3,846,130 | 11/1974 | Purol et al. | 96/55 |
| 3,847,619 | 11/1974 | Bissonette et al. | 96/76 R |
| 3,862,842 | 1/1975 | Bissonette | 96/55 |
| 3,923,511 | 12/1975 | Bissonette | 96/22 |

FOREIGN PATENT DOCUMENTS

| | | |
|---|---|---|
| 777,635 | 6/1957 | United Kingdom. |
| 1,329,444 | 9/1973 | United Kingdom. |

OTHER PUBLICATIONS

"Image Amplification Systems", *Research Disclosure,* vol. 116, No. 11660, 12/1973, pp. 109–114.

*Primary Examiner*—Dennis E. Talbert, Jr.
*Assistant Examiner*—Richard L. Schilling
*Attorney, Agent, or Firm*—Carl O. Thomas

[57] ABSTRACT

My invention is directed to a process of forming dye images. I accomplish this by bleaching a silver image at least in part with a cobalt bleaching agent to form within the silver image pattern an immobile cobalt reaction product. The concurrent presence of the immobile cobalt reaction product, a peroxide oxidizing agent and a dye-image-generating reducing agent within the silver image pattern allows a dye image to be formed which corresponds to the silver image pattern.

72 Claims, 11 Drawing Figures

PROCESS OF BLEACHING SILVER IMAGES TO FORM DYE IMAGES USING COBALT COMPLEXES AND PEROXIDES

CROSS-REFERENCE TO RELATED APPLICATIONS

This is a continuation-in-part of U.S. Ser. No. 602,156, filed Aug. 6, 1975, now abandoned.

FIELD OF THE INVENTION

The present invention relates to a novel process for producing photographic dye images. More specifically, the present invention relates to a process of forming photographic dye images which includes bleaching photographic silver images. The invention further contemplates the formation of photographic dye images through a redox replacement, including preferably amplification, of photographic silver images.

BACKGROUND OF THE INVENTION

The bleaching of photographic silver images using cobalt complexes is generally known in the art. British Pat. No. 777,635, for example, teaches the simultaneous bleaching and fixing of a subtractive color negative using a cobalt aquo-ammine cationic complex and a silver halide solvent as the bleaching and fixing agents. In my U.S. Pat. No. 3,923,511, issued Dec. 2, 1975, I disclose a process for producing a photographic dye image in a monobath. The monobath is comprised of a color-developer solution containing one or more developing agents including at least one color-developing agent and, optionally, a color coupler to which has been added a cobalt(III) complex and a silver halide solvent. Upon processing a photographic element containing a latent image in a silver halide emulsion layer, a silver image is first developed. The silver image is then amplified by an image dye-forming redox amplification reaction in which the cobalt(III) complex oxidizes the color-developing agent using image silver as a catalyst for the reaction. The oxidized color-developing agent then reacts with the color coupler to form a dye image. The silver image is bleached by excess cobalt(III) complex, and the silver halide is fixed by the silver halide solvent so that the photographic element leaving the processing monobath bears a photographic dye image but lacks a corresponding silver image. In specific, preferred embodiments, the monobaths of my above-cited patent application incorporate sequestering agents, such as ethylenediaminetetraacetic acid, capable of complexing with cobalt(II) to form a soluble reaction product. In this way, any risk of spontaneous oxidation of the developing agent by reoxidized cobalt reaction products is avoided.

The formation of photographic dye images through the use of peroxide oxidizing agents is also generally well-known in the art. For example, Matejec, U.S. Pat. No. 3,674,490, issued July 4, 1972, teaches the forming of a photographic silver image which can then be used to catalyze the redox reaction of a peroxide oxidizing agent and a color-developing agent. Useful catalytic materials are not limited to photographic silver images, but include noble metals of Groups Ib and VIII of the Periodic Table generally. Matejec, U.S. Pat. No. 3,776,730, issued Dec. 4, 1973, teaches the use of light-destructible peroxidase and catalase enzymes to catalyze the peroxide redox reaction. British Pat. No. 1,329,444 published Sept. 5, 1973, teaches forming a peroxide redox reaction catalyst by imagewise-exposing a simple or complex salt of a heavy metal of Group VIb, VIIb or VIII of the Periodic Table with a mono- or polybasic carboxylic acid. Weyde et al., U.S. Pat. No. 3,684,511, issued Aug. 15, 1972, teaches imagewise-exposing an iodoform or derivative compound to form a catalyst imagewise.

One of the significant disadvantages encountered in using peroxide redox reactions to generate photographic dye images has centered around the necessity of providing a clean catalyst surface. This is pointed out in *Research Disclosure,* Volume 116, Item No. 11660, titled "Image Amplification Systems", published December, 1973. A number of materials are disclosed which tend to become adsorbed to the surface of catalytic noble metal nuclei and thereby to interfere with peroxide oxidizing agent redox reactions with color-developing agents. These include adsorbed stabilizers, antifoggants and spectral-sensitizing dyes. Azoles and thiazoles which are free from mercaptan and ionic iodide moieties are taught to be useful without fouling catalytic surfaces. Mercaptotetrazoles, -oxazoles, and -imidazoles are taught to be avoided. Since peroxide-containing amplifier solutions may be poisoned by bromide ions or antifoggants carried over from conventional development solutions, it is taught to limit developing solutions to potassium bromide or antifoggant concentrations no greater than 1 gram per liter.

SUMMARY OF THE INVENTION

In one aspect, my invention is directed to a process of forming an image which comprises bleaching at least a portion of a silver image contained within a photographic element by reacting therewith, in the presence of a silver salt-forming compound which is incapable of oxidizing image silver, a cobalt(III) complex which permanently releases ligands upon reduction, while concurrently producing cobalt(II) as an immobile reaction product in a pattern conforming to the silver image pattern. The silver image is replaced with a dye image by (1) reacting a peroxide oxidizing agent with the cobalt(II) reaction product to form a cationic cobalt(III) oxidizing agent as a reaction product in a pattern conforming to the silver image pattern and (2) reacting with the cationic cobalt(III) oxidizing agent a dye-image-generating reducing agent. The peroxide oxidizing agent and the dye-image-generating reducing agent are chosen to be essentially inert to oxidation-reduction reaction in the absence of the cobalt(II) reaction product. The bleaching and dye image forming steps are each performed using an aqueous alkaline processing solution.

In another aspect, a photographic element containing at least one radiation-sensitive silver halide layer bearing a latent image pattern can be developed to form a silver image pattern therein and processed sequentially or concurrently to form a photographic dye image as described above.

In one specific, illustrative form, my invention is directed to a process of forming a photographic dye image which corresponds to and amplifies a photographic silver image present in a silver halide emulsion layer of a photographic element. I remove the silver image in an aqueous alkaline bleaching solution containing alkali or ammonium bromide, chloride or thiosulfate as a silver salt-forming compound which is incapable of oxidizing image silver and, as a cobalt(III) complex which permanently releases ligands upon reduction, a cobalt(III) complex having a coordination number of 6 and monodentate or bidentate ligands, at least four of which are ammine ligands. While the image silver is being bleached, an immobile cobalt(II) reaction product is formed in its place. I can now form the dye image which is to amplify the original silver image. Working again in aqueous alkaline processing solution, I react hydrogen peroxide, a preferred peroxide oxidizing agent, with a color-developing agent, a preferred dye-image-generating reducing agent, using the immobile cobalt(II) reaction product as a catalyst. The oxidized color-developing agent which is generated reacts with a color coupler to produce the dye image which corresponds to and amplifies the original silver image.

I have discovered that, when a photographic silver image pattern is bleached with a cobalt(III) complex in the presence of a silver salt-forming compound, an immobile cobalt(II) reaction product is produced which can be employed for photographic dye image formation and for redox amplification of the photographic silver image. To accomplish this, I bring a peroxide oxidizing agent into contact with the immobile cobalt(II) reaction product while it remains in an image pattern conforming to the silver image pattern where it was generated. The cobalt(II) reaction product then enters into a redox reaction with the peroxide oxidizing agent to generate a cationic cobalt(III) oxidizing agent. The newly generated cationic cobalt(III) oxidizing agent spontaneously oxidizes any due-image-generating reducing agent with which it comes in contact, so that a photographic dye image is formed corresponding to the original photographic silver image.

My novel process is advantageous in allowing a photographic dye image to be formed in a manner that simultaneously eliminates or reduces any unwanted photographic silver image. According to my invention, a photographic dye image can be formed while a corresponding photographic silver image is being bleached. In one preferred embodiment of my invention, it is not necessary even to form a separately viewable photographic silver image. Instead of using as a starting element for the practice of my process a photographic element which contains a photographic silver image, a photographic element can be employed which incorporates at least one silver halide emulsion layer bearing a latent image. In this instance, it is contemplated that both development and bleaching can take place concurrently in a single processing bath. The latent image can, of course, first be developed to a silver image and then moved to a processing bath for bleaching, if desired.

My process employs a novel and advantageous approach for achieving a redox amplification of a photographic image. Prior to my invention, both cobalt(III) complexes and peroxide oxidizing agents had been separately employed to produce photographic dye images. In these conventional amplification reactions, photographic silver images have been used merely to catalyze a redox reaction between a cobalt or peroxide oxidizing agent and a dye-image-generating reducing agent, such as a color-developing agent. In this way a photographic dye image can be produced, the density of which far exceeds that of the original photographic silver image. However, any cobalt(III) complex oxidizing agent present is consumed in a stoichiometric relationship to the image dye being formed. The formation of cobalt(III) by reoxidation of the cobalt(II) reaction product has heretofore been neither intended nor desired, and multidentate ligand-forming compounds are frequently used to insure that this does not occur.

By contrast, in my process the cobalt(III) complex required is only that necessary to bleach the photographic silver image. Cobalt(II) formed as a product of the bleaching reaction is oxidized to a cationic cobalt(III) oxidizing agent by a peroxide oxidizing agent. Upon oxidation of the dye-image-generating reducing agent by the cobalt(III), cobalt(II) can be again regenerated. This permits another molecule of peroxide again to oxidize the cobalt(II) to cationic cobalt(III) oxidizing agent. In this way cobalt can be cycled between its (II) and (III) oxidation states rather than being consumed in forming the photographic dye image. Thus, in my process neither the quantities of silver in the photographic silver image nor the amount of cobalt(II) produced by bleaching stoichiometrically limits the density of the photographic dye image which can be produced.

While I rely primarily upon the bleaching and amplification reactions described above for formation of a photographic dye image, the density and/or speed of formation of the photographic dye images formed according to my invention can be enhanced by other reactions producing image dye. For example, where the photographic element initially contains a latent image in a silver halide emulsion, the use of a color-developing agent to produce the silver image can be employed concurrently to produce image dye. Some additional image dye may also be produced as a result of the cobalt(III) complex's reacting with color-developing agent where the photographic silver image acts as a catalyst. Where the cobalt(III) complex is catalyzed by image silver to react with color-developing agent or any other dye-image-generating reducing agent present, the peroxide oxidizing agent can interact with the cobalt(II) reaction product formed to allow cobalt to cycle between its (II) and (III) oxidation states, thereby producing additional image dye, as has been described above.

One of the significant advantages of my process is that the peroxide oxidizing agent can be employed in my process even though one or a variety of materials are present that would be incompatible with conventional peroxide amplification reactions using a silver or other heterogeneous catalyst surface. For example, I specifically contemplate that my amplification process can be practiced in the presence of bromide concentrations which are incompatible with heterogeneous catalysis of peroxide amplification reactions.

It is another surprising feature of my invention that the peroxide oxidizing agent when present with the cobalt(III) complex in bleaching the silver image enhances bleaching. This is particularly unexpected, since enhancement of the silver image bleaching can be achieved under conditions where the peroxide oxidizing agent exhibits no detectable bleaching action when employed in the absence of the cobalt(III) complex bleaching agent.

It is a further advantage of my invention that it is quite adaptable to a variety of processing approaches. In one approach, a photographic element comprised of at least one silver halide emulsion layer bearing a latent image is developed to form a photographic silver image. The silver image is then bleached to produce an immobile cobalt(II) reaction product imagewise in a pattern conforming to the latent image pattern. An amplification reaction then occurs in which a peroxide oxidizing agent interacts with the cobalt(II) reaction product to allow the formation of the photographic dye image. Development, bleaching and amplification can be performed sequentially in successive processing solutions. Alternatively, development and bleaching can occur in a single processing solution while amplification occurs in a subsequent processing solution. In still another form, development can be omitted by starting with a photographic element which already contains a photographic silver image, and the remaining steps of bleaching and amplification can be performed sequentially in separate processing solutions or concurrently in a single processing solution. In still another form, the steps of development, bleaching and amplification can all be carried out in a single processing solution. In most instances where silver halide is being developed it is convenient to fix the silver halide concurrently with bleaching. Fixing can, alternatively, be carried out in a separate processing solution or omitted entirely in many applications.

It is a still further surprising and advantageous feature of my invention that a compound which is capable of complexing with cobalt to form tridentate or higher dentate chelate ligands can produce enhanced photographic dye image densities when incorporated in developing solutions employed in the practice of my invention. I have further found unexpectedly that these multidentate ligand-forming compounds can be usefully employed during amplification to minimize background stain. The utility of the multidentate ligand-forming compounds in the amplification step is surprising, since these compounds can interact with cobalt(II) to produce a soluble, noncatalytic complex. Surprisingly, the multidentate ligand-forming compounds have a useful effect during both development and amplification. While I prefer to limit the concentration of these multidentate ligand-forming compounds during initial formation of the cobalt(II) reaction product formed during bleaching, so that the formation of an immobile cobalt(II) reaction product is favored, low levels of these compounds can be usefully present during bleaching and concurrent formation of the cobalt(II) reaction product.

Still other surprising and advantageous features of my invention will become apparent from the following detailed description. For example, advantages which are best illustrated by reference to a particular mode of practicing my invention are discussed below.

FIGS. 1 and 3 each contain a plot of a cyan dye image and two silver image characteristic (or H and D) curves for a red-sensitized silver halide emulsion layer.

DESCRIPTION OF THE PREFERRED EMBODIMENTS

Figure 1:
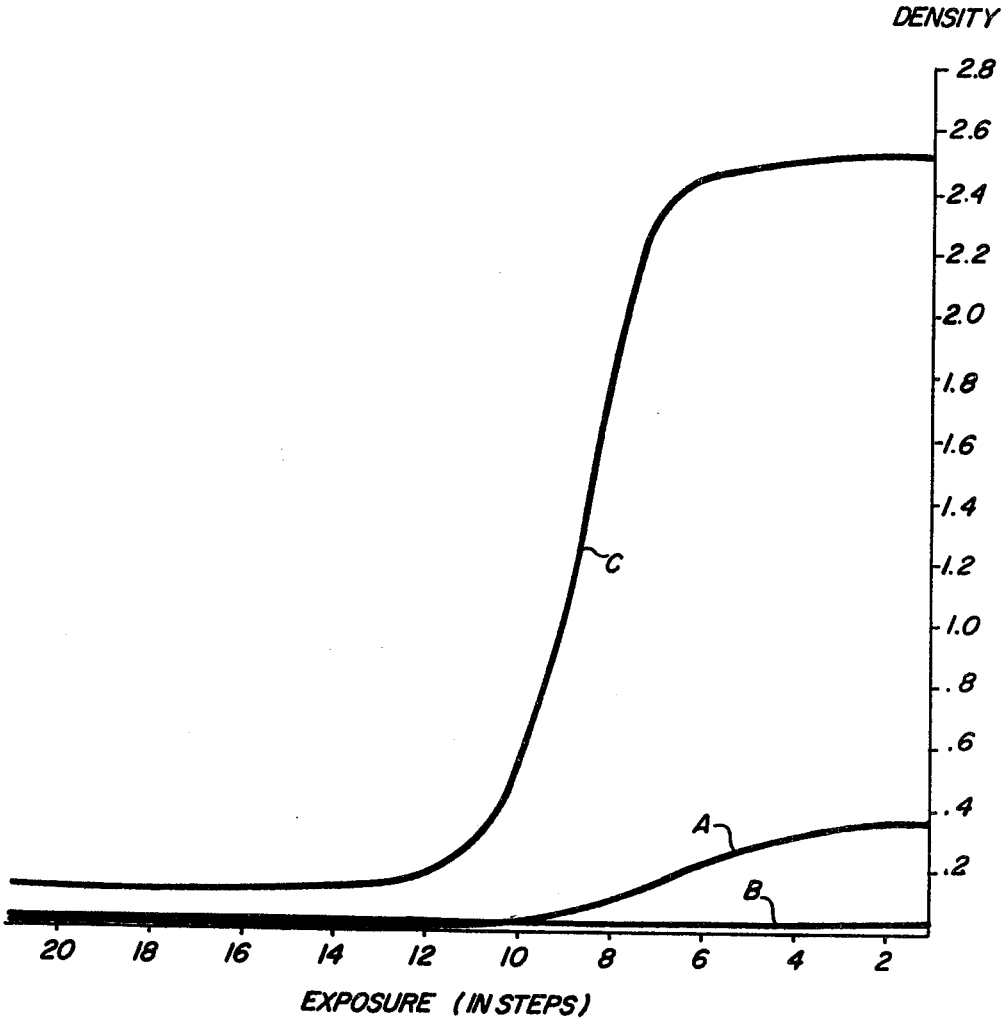

In one specific form the practice of my invention begins by providing an element bearing a silver image. The silver image can be conveniently formed by imagewise exposing and developing a photographic element comprised of at least one radiation-sensitive silver halide emulsion layer. Development of the photographic silver image can be achieved by any convenient conventional processing approach. In general, the photographic element can be developed after exposure in a developer solution containing a developing agent, such as a polyhydroxybenzene, aminophenol, paraphenylenediamine, pyrazolidone, pyrazolone, pyrimidine, dithionite, hydroxylamine, hydrazine or other conventional developing agent. A variety of suitable conventional developing agents are disclosed, for example, in *The Theory of the Photographic Process* by Mees and James, 3rd Edition, Chapter 13, titled "The Developing Agents and Their Reactions", published by MacMillan Company (1966), the disclosure of which is here incorporated by reference.

The photographic developers employed in the practice of my invention can include, in addition to conventional developing agents, other conventional components. The developers are typically aqueous solutions, although organic solvents, such as diethylene glycol, can also be included to facilitate the solvency of organic components. Since the activity of developing agents is frequently pH-dependent, it is contemplated to include activators for the developing agent to adjust the pH. Activators typically included in the developer are sodium hydroxide, borax, sodium metaborate, sodium carbonate and mixtures thereof. Sufficient activator is typically included in the developer to maintain an alkaline developer solution, usually at a pH above 8.0 and, most commonly, above 10.0 to a pH of about 13. To reduce aerial oxidation of the developing agent and to avoid the formation of colored reaction products, it is commonplace to include in the developer a preservative, such as sodium sulfite. It is also common practice to include in the developer a restrainer, such as potassium bromide, to restrain nonimage development of the silver halide with the consequent production of developemnt fog. To reduce gelatin swelling during development, compounds such as sodium sulfate may be incorporated into the developer. Also compounds, such as sodium thiocyanate may be present to reduce granularity. Generally any conventional photographic developer for silver halide photographic emulsions can be employed in the practice of my invention. Specific illustrative photographic developers are disclosed in the *Handbook of Chemistry and Physics,* 36th Edition, under the title "Photographic Formulae" at page 3001 et seq. and in *Processing Chemicals and Formulas,* 6th Edition, published by Eastman Kodak Company (1963), the disclosures of which are here incorporated by reference.

In one form of my invention I specifically contemplate incorporating into the developer solution a sequestering or chelating agent for the purpose of increasing the density of the photographic dye image which is ultimately produced. The chelating agent can also be used to control background dye densities, that is, stain attributable to unwanted dye formation. I have observed that inclusion of ethylenediaminetetraacetic acid, which is known to form a multidentate ligand with cobalt, enhances the density of the photographic dye image formed according to my process. The effectiveness of ethylenediaminetetraacetic acid for this purpose is surprising, since it is believed that ethylenediaminetetraacetic acid forms a stable, soluble complex with cobalt which will not spontaneously oxidize dye-image-generating reducing agent if the cobalt is reoxidized to its III oxidation state. Other compounds which similarly chelate with cobalt include sodium metaphosphate, sodium tetraphosphate, 2-hydroxypropylenediaminetetraacetic acid, and the like. While any quantity of sequestering agent can be employed which will produce an effective enhancement of the photographic dye image, I generally prefer to employ the sequestering agent in the developer in a concentration of from 1 mg/liter up to 10 grams per liter.

As employed herein, the term "multidentate ligand" is defined as a ligand of a cobalt complex which forms three or more coordination bonds with cobalt. Tridentate and higher dentate ligands of cobalt are thus multidentate ligands. A monodentate or bidentate ligand of a cobalt complex is bonded to cobalt at one or two coordination bonding sites, respectively.

After photographic elements employed in the practice of my invention have been developed according to the procedure described above, they can be immediately subjected to a bleaching step of my process or, alternatively, the photographic elements can be fully processed in a conventional manner to form a stable, viewable photographic image. For example, after development of the photographic silver image, the photographic element can be processed through stop, fix and rinse baths prior to being subjected to the bleaching step of my process.

In one form, the practice of my process can begin with the bleaching of a photographic silver image. In other words, it is not essential that my process begin with exposing a photographic element containing at least one silver halide emulsion layer so that it bears a latent image. The silver image can be formed by any convenient conventional technique known in photography. For example, photographic elements containing silver images formed from light-sensitive silver salts other than silver halides can be employed to form the photographic silver image.

An element bearing a photographic silver image in one form of my invention is placed into a conventional alkaline bleaching solution containing a cobalt(III) complex and a compound which is capable of forming a salt with silver but which is incapable of directly oxidizing image silver. Aqueous alkaline bleach solutions of this general type have been disclosed, for example, in British Patent 777,635, cited above, and Stephen, U.S. Pat. No. 3,615,508, issued Oct. 26, 1971, the disclosures of which are here incorporate by reference.

The cobalt(III) complexes employed in the practice of my invention are chosen from among those which permanently release ligands upon reduction. As is well-understood in the art, cobalt(III) complexes release ligands upon reduction. The cobalt(III) complexes with I employ are those which upon reoxidation following reduction are not regenerated. Where monodentate or bidentate ligands are initially present in a cobalt(III) complex, these ligands are generally so mobile that, once released, they migrate away from the cobalt(III) and cannot be recaptured when the cobalt is reoxidized to cobalt(III). I accordingly prefer to employ cobalt(III) complexes in which each of the ligands present is a monodentate and/or bidentate ligand. Such complexes are disclosed, for example, in my U.s. Pat. No. 3,923,511, cited above; in my U.S. Pat. Nos. 3,834,907 (issued Sept. 10, 1974); 3,862,842 (issued Jan. 28, 1975); 3,856,524 (issued Dec. 24, 1974); and 3,826,652 (issued July 30, 1974); in J. S. Dunn U.S. Pat. No. 3,822,129 (issued July 2, 1974); in R. G. Mowrey et al. U.S. Pat. No. 3,841,873 (issued Oct. 15, 1974); and in W. B. Travis U.S. Pat. No. 3,765,891 (issued Oct. 16, 1973). The disclosures of these patents are here incorporated by reference.

Particularly preferred cobalt(III) complexes useful in the bleaching step of my process have a coordination number of 6 and have mono- or bidentate ligands chosen from among ligands such as alkylenediamine, ammine, aquo, nitrate, nitrite, azide, chloride, thiocyanate, isothiocyanate, carbonate and similar ligands commonly found in cobalt(III) complexes. Especially useful are the cobalt(III) complexes comprising four or more ammine ligands, such as $[Co(NH_3)_6]X$, $[Co(NH_3)_5H_2O]X$, $[Co(NH_3)_5CO_3]X$, $[Co(NH_3)_5Cl]X$ and $[Co(NH_3)_4CO_3]X$, wherein X represents one or more anions determined by the charge neutralization rule and X preferably represents a polyatomic organic anion.

As has been recognized in the art, with many complexes, such as cobalt hexammine, the anions selected can substantially affect the reducibility of the complex. The following ions are listed in the order of those which give increasing stability to cobalt hexammine complexes: bromide, chloride, nitrite, perchlorate, acetate, carbonate, sulfite and sulfate. Other ions will also affect the reducibility of the complex. These ions should, therefore, be chosen to provide complexes exhibiting the desired degree of reducibility. Some other useful anions include thiocyante, dithiocyanate and hydroxide. Neutral complexes such as $[Co(dien)SCN)_2OH]$ are useful, but positively charged complexes are generally preferred.

In certain highly preferred embodiments, the cobalt(III) complexes used in this invention contain at least four ammine ($NH_3$) ligands and/or have a net positive charge which is preferably a net charge of +3. A cobalt(III) ion with six ($NH_3$) ligands has a net charge of +3. A cobalt(III) ion with five ($NH_3$) ligands and one chloro ligand has a net charge of +2. A cobalt(III) ion with two ethylenediamine(en) ligands and two ($N_3$) azide ligands has a net charge of +1. Generally, the best results have occurred where the cobalt(III) complex has a net charge of +3 and/or where the cobalt(III) complex comprises at least 3 and preferably at least 5 ammine ligands.

Generally, any concentration of the cobalt(III) complex which has heretofore been found useful in conventional bleaching and photographic dye image redox amplification solutions can be used in the practice of my process. The most useful concentration of the cobalt(III) complex in the bleaching solution depends on numerous variables, and the optimum level can be determined from observing the interaction of specific photographic elements and bleaching solutions. With cobalt hexammine chloride or acetate, for example, good results are obtained with about 0.2 to 20 and, preferably, about 0.4 to 10 grams of cobalt(III) complex per liter of processing solution. It is a significant and surprising feature of my invention that the density of the photographic dye image is not stoichiometrically related to the concentration of the cobalt(III) complex employed. Hence, it is apparent that a substantial concentration range of the cobalt(III) complex can be employed within the purview of the invention. Further, as will be more fully discussed below, the cobalt(III) complex need not be present in the bleaching solution as initially formulated, but can be incorporated in the photographic element being bleached, if desired; hence there is no minimum required cobalt(III) complex concentration in the bleaching solution.

In addition to the cobalt(III) complex incorporated in the bleaching solution, a compound is incorporated which is capable of forming a silver salt but which is incapable of oxidizing image silver. Where the photographic element is chosen so that it contains unfixed silver halide at the time of bleaching, these silver salt-forming compounds can, in a preferred form of my process, be used in combination with the cobalt(III) complex simultaneously to bleach and fix the photographic element.

The silver salt-forming compounds employed in my bleaching step can, in one form, take the form of a conventional silver halide solvent. Silver halide solvents are defined as compounds which, when employed in an aqueous solution (60° C), are capable of dissolving more than ten times the amount (by weight) of silver halide which can be dissolved in water at 60° C.

Typical useful silver halide solvents include water-soluble thiosulfates (e.g., sodium thiosulfate, potassium thiosulfate, ammonium thiosulfate, etc.), thiourea, ethylenethiourea, a water-soluble thiocyanate (e.g., sodium thiocyanate, potassium thiocyanate and ammonium thiocyanate), and a water-soluble sulfur-containing dibasic acid. Water-soluble diols used to advantage include those having the formula: $HO(CH_2CH_2Z)_pCH_2CH_2OH$, wherein p is an integer of from 2 to 13, and Z represents oxygen or sulfur atoms such that at least one third of the Z atoms is sulfur and there are at least two consecutive Z's in the structure of the compound which are sulfur atoms. The diols advantageously used are also included in compounds having the formula: $HO(—CH_2CH_2X)_{c-1}(CH_2CH_2X^1)_{d-1}(—CH_2CH_2X)_{e-1}(CH_2CH_2X^1)_{f-1}(CH_2CH_2X)_{g-1}—CH_2CH_2OH$, wherein X and $X^1$ represent oxygen or sulfur, such that when X represents oxygen $X^1$ represents sulfur, and when X represents sulfur, $X^1$ represents oxygen; and each of *c, d, e, f,* and *g* represents an integer of from 1 to 15, such that the sum of $c+d+e+f+g$ represents an integer of from 6 to 19, and such that at least one third of the total of all the X's plus all the $X^1$'s represent sulfur atoms and at least two consecutive X's and/or $X^1$'s in the structure of the compound are sulfur atoms.

Typical diols include the following:

1. 3,6-dithia-1,8-octanediol $HOCH_2CH_2SCH_2Ch_2SCH_2CH_2OH$ 2. 3,6,9-trithia-1,11-undecanediol $HOCH_2CH_2SCH_2CH_2SCH_2Ch_2SCH_2CH_2OH$ 3. 3,6,9,12-tetrathia-1,14-tetradecanediol $HO(CH_2CH_2S)_4Ch_2CH_2OH$ 4. 0-oxo-3,6,9,12,15-tetrathia-1,17-heptadecanediol $HO(CH_2CH_2S)_2CH_2CH_2O(CH_2CH_2S)_2Ch_2Ch_2OH$ 5. 9,12-dioxa-3,6,15,18-tetrathia-1,20-eicosanediol $HO(CH_2Ch_2S)_2(CH_2CH_2O)_2(CH_2CH_2S)_2(CH_2OH$ 6. 3,6-dioxo-9,12-dithia-1,14-tetradecanediol $HO(CH_2Ch_2O)_2(CH_2CH_2S)_2Ch_2CH_2OH$ 7. 3,12-dioxo-6,9-dithia-1,14-tetradecanediol $HOCH_2CH_2O(Ch_2Ch_2S)_2CH_2CH_2OCH_2CH_2OH$ 8. 3,18-dioxa-6,9,12,15-tetrathia-1,20-eicosanediol $HOCH_2Ch_2O(Ch_2CH_2S)_4Ch_2CH_2OCH_2Ch_2OH$ 9. 12,18-dioxo-3,6,9,15,21,24,27-heptathia-1,29-nonacosanediol $HO(CH_2CH_2S)_3CH_2CH_2OCH_2CH_2SCH_2Ch_2O(CH_2Ch_2S)_3CH_2Ch_2OH$ 10. 6,9,15,18-tetrathia-3,12,21-trioxo-1,23-tricosanediol $HOCH_2CH_2O(CH_2Ch_2S)_2CH_2CH_2O(CH_2Ch_2S)_2CH_2CH_2OCH_2CH_2OH$ Water-soluble sulfur-containing dibasic acids which can be used include those having the formula: $HOOCH_2(SCH_2Ch_2)_qSCH_2COOH$, in which q represents an integer of from 1 to 3 and the alkali metal and ammonium salts of said acids. Typical illustrative examples include:

1. ethylene-bis-thioglycolic acid $HOOCCH_2SCh_2Ch_2SCH_2COOH$ 2. 3,6,9-trithiahendecane dioic acid $HOOCCH_2(SCH_2CH_2)_2SCH_2COOH$ 3. 3,6,9,12-tetrathiatetradecanedioic acid $HOOCCH_2(SCH_2Ch_2)_3SCH_2COOH$ 4. ethylene-bis-thioglycolic acid disodium salt
5. ethylene-bis-thioglycolic acid dipotassium salt
6. ethylene-bis-thioglycolic acid diammonium salt
7. 3,6,9-trithiahendecane dioic acid disodium salt
8. 3,6,9,12-tetrathiatetradecanedioic acid disodium salt The silver halide solvent can be incorporated in the bleaching bath within conventional concentration limits, such as those disclosed, for example, in my U.S. Pat. No. 3,923,511 and British Pat. No. 777,635, both cited above. Where the silver halide solvent is being incorporated into the bleaching bath and it is desired to bleach and fix an element containing a photographic silver halide emulsion layer, optimum concentrations of the silver halide solvent in the bleaching bath can vary significantly, depending upon such factors as the thickness and composition of the emulsion layer, the pH of the bleaching solution, the temperature of processing, agitation, etc. Generally, in a preferred form of my invention, from about 0.2 to 250 grams or to the saturation limit of solubility of an ammonium or alkali metal thiosulfate are used per liter of processing solution and, most preferably, about 0.5 to 150 grams of sodium thiosulfate are employed per liter of the bleaching bath.

Although the use of a silver halide solvent can be relied upon to bleach and/or fix efficiently a photographic element containing a photographic silver image in a silver halide emulsion layer, the use of a silver halide solvent is not required for the practice of my process. I have observed that silver image bleaching can be satisfactorily achieved alternatively by employing high levels of bromide or chloride ions in the bleaching solution. The same water-soluble bromide and chloride ion-providing compounds can be employed in the bleaching solution as are typically employed in developer solutions. For example, ammonium and alkali metal bromides and chlorides are fully satisfactory for use in the bleaching solutions of my process. Useful silver image bleaching can be achieved with these halide ions at concentrations above about 0.08 mole of halide ion per liter. Typically, where it is intended merely to bleach the pbotographic silver image and fixing of silver halide is not required, concentrations of these halide ions above about 0.4 mole of halide ion per liter are unnecessary to achieving satisfactory results. However, very high concentrations of chloride and bromide ions are contemplated, particularly where concurrent fixing of silver halide is desired. The bromide and chloride ions can generally be incorporated up to the solubility limits of the salt being employed. Where these halide ions are employed in combinations with silver halide solvents, lesser quantities of halide ion can contribute usefully to bleaching and fixing of photographic elements processed according to my invention.

Instead of substituting halide ions wholly or partially for silver halide solvents in the bleaching solution, it is also possible to omit both silver halide solvents and halide ions from the bleaching solution entirely. That is, the bleaching solution need not contain a compound which forms a soluble salt with silver but which is incapable of bleaching image silver. In this form of my process, a silver halide solvent is incorporated in the photographic element being processed instead of the bleaching bath. For example, certain silver halide solvents, e.g., isothiuronium, thiuronium compounds, bis-isothiuronium compounds and 3-S-thiuronium salts, can be incorporated in photographic elements to be processed according to my invention. Solvents of this type are described in U.S. Pat. Nos. 3,506,444 (issued Apr. 14, 1970), 3,669,670 (issued June 13, 1972) and 3,301,678 (issued Jan. 31, 1967). These silver halide solvents can, of course, be wholly or partially incorporated in the bleaching bath, if desired.

The end which I achieve through subjecting an element having a photographic silver image to a bleaching bath is substantially different from that heretofore sought in the art. Whereas the art has heretofore employed bleaching baths to remove the photographic silver image and, in most instances, to fix concurrently any radiation-sensitive silver halide present, bleaching and fixing are not the essential features of my process. While in many applications bleaching and fixing of a photographic element being processed according to my invention is a desirable and intended result, in many applications of my process the photographic silver image can be left at least partially unbleached and any residual radiation-sensitive silver halide can be left unfixed.

Quite surprisingly, I have recognized that bleaching is a means of obtaining an image pattern of catalytic cobalt(II) formed as an immobile reaction product corresponding to the photographic silver image (which usually in turn conforms to an original latent image pattern formed on imagewise exposure of the photographic element). Whereas the cobalt(II) reaction product formed in conventional photographic silver image bleaching has been viewed as a byproduct of the process, I have observed quite unexpectedly that this reaction product can be generated and retained in an image pattern and can be used to catalyze a redox amplification reaction.

Whereas both alkaline and acidic bleaching and fixing baths containing cobalt(III) complexes have been disclosed in the art, I employ only alkaline bleaching baths in the practice of my invention. I have observed that the cobalt(II) reaction products formed by bleaching can be retained in an image pattern in alkaline bleaching baths, that is, baths having a pH above 7.0. However, at the lower alkaline pH values a portion of the cobalt(II) formed as a reaction product is not retained within the photographic element after formation. Accordingly, for applications where maximum retention of the cobalt(II) reaction product in an image pattern is desired, I prefer that the bleaching bath be maintained at a pH of at least 10. The alkaline pH ranges normally encountered in developing dye image-forming photographic elements, typically from about 10 to 13, are quite useful ranges for the bleach baths employed in the practice of my invention. Generally, any of the activators described above for use in the photographic-developer baths can be employed in the bleach baths of my process to adjust or control alkalinity.

In one specific aspect, the bleach baths used in the practice of my invention can be formed merely by substituting for the developing agent in an alkaline developer solution a cobalt(III) complex of the type and in the concentration ranges discussed above. If the developer solution does not already contain a silver salt-forming compound which is incapable of reducing image silver, one or more of those described above can be added in the concentrations stated to complete the bleach bath. Of course, neither the cobalt(III) complex nor the silver salt-forming compound need be added to complete the bleach bath if they are alternatively incorporated initially within the photographic element being processed. It is preferred that the bleach baths employed in the practice of my invention contain less than a 0.05 molar concentration of a multidentate ligand-forming compound, as described above, most preferably less than a 0.01 molar concentration, so that the formation of an immobile, catalytic cobalt(II) reaction product is favored. Sequestering agents of the type and in the concentrations described above for inclusion in the developer solutions can produce similar advantages when incorporated in the bleach baths.

It is a surprising feature of my process that a nondiffusing imagewise distribution of cobalt(II) is formed as a reaction product upon oxidation of image silver by a cobalt(III) complex in an alkaline bleaching bath. While I do not wish to be bound by any particular theory to account for the preservation of the image pattern by the cobalt(II), one possible explanation is that the cobalt(II) produced as a reaction product may immediately complex with water contained in the bleaching solution to form an aquo-cobalt(II) complex which is both catalytic for the redox amplification reaction to follow and immobile in the bleaching and amplification solutions. Where photographic elements are chosen for processing, which elements contain the photographic silver image in a hydrophilic colloid vehicle or peptizer, the cobalt(II) formed upon bleaching of the image silver may become associated with the hydrophilic colloid ionically or physically so that its mobility is restricted. I have particularly observed that photographic silver images produced through the development of a gelatino-silver halide emulsion layer produce cobalt(II) catalysts which conform well to the original latent image pattern of the emulsion layer. It is contemplated that a combination of water and hydrophilic colloid (e.g., gelatin) interactions with imagewise generated cobalt(II) may account for its surprising immobility in aqueous solutions.

In one form of my invention, after forming an imagewise distribution of a catalytic cobalt(II) reaction product, I transfer the photographic element being processed to a peroxide oxidizing agent containing redox amplification bath. The amplification bath can take the form of conventional peroxide oxidizing agent containing redox amplification baths of the type disclosed in U.S. Pat. Nos. 3,674,490, 3,776,730 and 3,684,511, each cited above. The bath can also take the form of that disclosed in British Pat. No. 1,329,444 or "Image Amplification Systems", Item No. 11660 of *Research Disclosure,* both cited above. The disclosures of each of the above are herein incorporated by reference. These redox amplification baths are aqueous solutions containing a peroxide oxidizing agent.

The peroxide oxidizing agents employed in the practice of my invention can be chosen from among conventional peroxide oxidizing agents which are known to require the presence of a catalyst to oxidize a silver halide developing agent or a dye-image-generating reducing agent. Peroxide oxidizing agents of this type include water-soluble compounds containing a peroxy group, such as inorganic peroxide compounds or salts of peracids. For example, perborates, percarbonates or persilicates and, particularly, hydrogen peroxide, can be employed as peroxide oxidizing agents in the practice of my invention as well as organic peroxide compounds such as benzoyl peroxide, percarbamide and addition compounds of hydrogen peroxide and aliphatic acid amides, polyalcohols, amines, acylsubstituted hydrazines, etc. I prefer to employ hydrogen peroxide, since it is highly active and easily handled in the form of aqueous solutions. Peroxide oxidizing agent concentrations of from 0.001 mole to 0.5 mole per liter of amplification bath are preferred.

Except where an immobile dye-image-generating reducing agent, such as a redox dye-releaser, is incorporated in the photographic element, the redox amplification bath contains a mobile dye-image-generating reducing agent. The dye-image-generating reducing agent can be of any conventional type heretofore employed in redox amplification baths. In one form, the dye-image-generating reducing agent is a compound which forms a highly colored reaction product upon oxidation or which upon oxidation is capable of reacting with another compound, such as a color coupler, to form a highly colored reaction product. Where the dye-image-generating reducing agent forms a colored reaction product directly upon oxidation, it can take the form of a dye precursor such as, for example, a leuco dye or vat dye that becomes highly colored upon oxidation.

Where the dye-image-generating reducing agent is oxidized to form a highly colored reaction product with another compound, such as a color coupler, the dye-image-generating reducing agent is preferably employed in the form of a color-developing agent. Any primary aromatic amine color-developing agent can be used in the process of my invention, such as p-aminophenols or p-phenylenediamines. Color-developing agents which can be used include 3-acetamido-4-amino-N,N-diethylaniline, 4-amino-N-ethyl-N-β-hyroxyethylaniline sulfate, N,N-diethyl-p-phenylenediamine, 2-amino-5-diethylaminotoluene, N-ethyl-N-β-methanesulfonamidoethyl-3-methyl-4-aminoaniline, 4-amino-N-ethyl-3-methyl-N-(β-sulfoethyl)aniline and the like. See Bent et al., *JACS,* Vol. 73, pp. 3100–3125 (1951), and Mees and James, *The Theory of the Photographic Process,* 3rd Edition, 1966, published by MacMillan Co., New York, pp. 278–311, for further typical useful developing agents. Aromatic primary amino color-developing agents which provide particularly good results in this invention are 4-amino-N,N-diethylaniline hydrochloride, 4-amino-3-methyl-N,N-diethylaniline hydrochloride, 4-amino-3-methyl-N-ethyl-N-β-(methanesulfonamide)ethylaniline sulfate hydrate, 4-amino-3-methyl-N-ethyl-N-β-hydroxyethylaniline sulfate, 4-amino-3-dimethylamino-N,N-diethylaniline sulfate hydrate, 4-amino-3-methoxy-N-ethyl-N-β-hydroxyethylaniline hydrochloride, 4-amino-3-β-(methanesulfonamide)ethyl-N,N-diethylaniline dihydrochloride and 4-amino-N-ethyl-N-(2-methoxyethyl)-m-toluidine di-p-toluene sulfonate.

A black-and-white developing agent can be used in combination with color-developing agent. The black-and-white developing agent can be incorporated in the amplification bath or the photographic element, e.g., as described in *Research Disclosure,* Vol. 108, Item 10828, published April, 1973. Upon reaction with the peroxide oxidizing agent, oxidized black-and-white developer can crossoxidize with the color-developing agent to generate oxidized color-developing agent which forms dye by reaction with color couplers.

The color couplers employed in combination with the color-developing agents include any compound which reacts (or couples) with the oxidation products of a primary aromatic amino developing agent on photographic development to form an image dye, and also any compound which provides useful image dye when reacted with oxidized primary aromatic amino developing agent such as by a coupler-release mechanism. These compounds have been variously termed "color couplers", "photographic color couplers", "dye-image-generating couplers", etc., by those skilled in the photographic arts. The photographic color couplers can be incorporated in the amplification bath or in the photographic element, e.g., as described and referred to in *Product Licensing Index,* Vol. 92, December, 1971, page 110, paragraph XXII. When they are incorporated in the element, they preferably are nondiffusible in a hydrophilic colloid binder (e.g., gelatin) useful for photographic silver halide. The couplers can form diffusible or nondiffusible dyes. Typical preferred color couplers include phenolic, 5-pyrazolone and open-chain ketomethylene couplers. Specific cyan, magenta and yellor color couplers which can be employed in the practice of this invention are described in Graham et al., U.S. Pat. No. 3,046,129 issued Jan. 24, 1962, column 15, line 45, through column 18, line 51, which disclosure is incorporated herein by reference. Such color couplers can be dispersed in any convenient manner, such as by using the solvents and the techniques described in U.S. Pat.

Nos. 2,322,027 by Jelley et al. issued June 15, 1943, or 2,801,171 by Fierke et al issued July 30, 1957. When coupler solvents are employed, the most useful weight ratios of color coupler to coupler solvent range from about 1:3 1:0.1. The useful couplers include Fischer-type incorporated couplers such as those described in Fischer, U.S. Pat. No. 1,055,155 issued Mar. 4, 1913, and particularly nondiffusible Fischer-type couplers containing branched carbon chains, e.g., those referred to in Willems et al., U.S. Pat. No. 2,186,849. Particularly useful in the practice of this invention are the nondiffusible color couplers which form nondiffusible dyes.

Instead of producing a color reaction product upon oxidation, the dye-image-generating reducing agent can be of a type which is initially colored, but which can be used to provide an imagewise distribution of image dye by alteration of its mobility upon oxidation. Image-dye-generating reducing agents of this type include dye developers of the type disclosed, for example, in Rogers U.S. Pat. Nos. 2,774,668 (issued Dec. 18, 1956) and 2,983,606 (issued May 9, 1961), here incorporated by reference. These compounds are silver halide developing agents which incorporate a dye moiety. Upon oxidation by the peroxide oxidizing agent directly or acting through a cross-oxidizing auxiliary silver halide developing agent (such as described above), the dye developer alters its mobility to allow a dye image to be produced. Typically, the dye developer goes from an initially mobile to an immobile form upon oxidation in the redox amplification bath.

Other dye-image-generating reducing agents which produce dye image patterns by alteration of mobility are redox dye-releaser dye image forming compounds (also referred to as RDR's). The redox dye-releasers are initially immobile and undergo oxidation followed, in certain instances, by hydrolysis in an aqueous alkaline environment to provide an imagewise distribution of a mobile image dye. Compounds of this type are disclosed, for example, in Whitmore et al. Canadian Pat. No. 602,607 (issued Aug. 2, 1960); Fleckenstein Belgian Pat. No. 788,268 (issued Feb. 28, 1973); Fleckenstein et al. published U.S. patent application Ser. No. B351,673 (published Jan. 28, 1975); Gompf U.S. Pat. No. 3,698,897; Becker et al. U.S. Pat. No. 3,728,113; Anderson et al. U.S. Pat. No. 3,725,062; and U.S. Pat. Nos. 3,443,939; 3,443,940; 3,443,941; 3,390,380 and the like; all of which are here incorporated by reference.

Redox dye-releasers are similar to color-developing agents employed in combination with cross-oxidizing developing agents (also referred to in this type of use as electron transfer agents) in that redox dye-releasers react through an intermediate redox couple provided by a cross-oxidizing silver halide developing agent. In this redox couple the silver halide developing agent reacts with the cobalt(III) oxidizing agent to form oxidized developing agent. The oxidized developing agent then react with the redox dye-releaser and is regenerated. The oxidized redox dye-releaser hydrolyzes in an aqueous alkaline medium to release mobile dye. The aqueous alkaline medium preferably has a pH of at least 10 and can take the form of any of the processing baths in which the peroxide oxidizing agent can be incorporated in the practice of my invention. Where the dye-image-generating reducing agent is a redox dye-releaser, it is initially immobile and is incorporated in the photographic element to be processed. The cross-oxidizing silver halide developing agent employed can take the form of any conventional cross-oxidizing black-and-white or color-developing agent. Exemplary useful cross-oxidizing silver halide developing agents are disclosed in the patents relating to redox dye-releasers set forth above. Illustrative examples of preferred developing agents useful as cross-oxidizing developing agents (or electron transfer agents) in practicing this invention include 1-phenyl-3-pyrazolidone, 1-phenyl-4,4-dimethyl-3-pyrazolidone and 4-hydroxymethyl-4-methyl-1-phenyl-3-pyrazolidone.

The term "nondiffusible" used herein as applied by dye-image-generating reducing agents, couplers and their reaction products has the meaning commonly applied to the term in color photography and denotes materials which for all practical purposes do not migrate nor wander through photographic hydrophilic colloid layers, such as gelatin, particularly during processing in aqueous alkaline solutions. The same meaning is attached to the term "immobile". The terms "diffusible" and "mobile" have the converse meaning.

The mobile dye-image-generating reducing agents and color couplers, if any, can be incorporated initially entirely within the amplification bath, within the photographic element being processed or distributed between the two in any desired manner. The silver halide developing agents used as cross-oxidizing agents and color-developing agents can be incorporated initially within the photographic elements (as is well understood in the art), but they are preferably incorporated within the amplification bath. For most applications, it is preferred that the color couplers be incorporated within the photographic elements being processed. Where the dye-image-generating reducing agent is of a type which provides an image by alteration in mobility, it is usually preferred that it be initially incorporated within the photographic element. The amount of dye-image-generating reducing agent incorporated within the amplification bath can be varied over a wide range corresponding to the concentrations in conventional photographic developer baths. The amount of developing agent used in the amplification bath is preferably from about 1 to 20 and, most preferably, from about 2 to 10 grams per liter, although both higher and lower concentrations can be employed.

Since the dye-image-generating reducing agents employed in the practice of my process have heretofore been employed in the art in silver halide developer solutions, best results can be obtained by maintaining the amplification bath within the alkaline pH ranges heretofore employed in developing photographic silver halide emulsions to form dye images using these dye-image-generating reducing agents. Preferred alkalinity for the amplification bath is at least 8, most preferably from 10 to 13. The amplification bath is typically maintained alkaline using activators of the type described above in connection with the developing step of my process.

Other addenda known to facilitate image-dye formation in alkaline photographic developer solutions with specific dye-image-generating reducing agents can also be included in the amplification bath. For example, where incorporated color couplers are employed, it may be desirable to incorporate an aromatic solvent such as benzyl alcohol to facilitate coupling. Where lower pH alkaline amplification baths are being employed in combination with RDR-containing photographic elements, the mobility of the released dye can be enhanced by incorporating amino acids or combinations of amines and aliphatic carboxylic acids. Exemplary useful compounds include ω-amino acids, such as 2-aminoacetic acid, 4-aminobutyric acid, 6-aminohexanoic acid, 11-aminoundecanoic acid and 12-aminododecanoic acid. Such released dye solubilizers can be present in the amplification bath in concentrations of from about 0.1 to 60 grams per liter, preferably from about 1 to 20 grams per liter.

The foregoing embodiments of my process can be characterized as a sequential mode of practicing my invention in that separate bleaching and amplification baths are employed. Photographic silver image formation need not form a part of my sequential processing mode, but, where included, development is carried out in a separate developing bath before the photographic element being acted upon reaches the bleaching bath. As has been noted above, stop, fix and rinsing steps of a conventional character can be employed between the developing step and the bleaching step. It is also contemplated that additional processing steps can be undertaken between bleaching and amplification. For example, where the bleaching bath is of low alkalinity, it may be desirable to insure immobilization of the cobalt(II) reaction product by rinsing the photographic element in an aqueous alkaline solution having a higher pH, preferably at least 10, before introducing the photographic element into the amplification bath. Where it is desired to view the dye image within the photographic element being processed, it is contemplated that stop, fix and rinse steps of a conventional nature can be practiced after removing the photographic element from the amplification bath. In the preferred form of my process, of course, subsequent fixing is unnecessary, since this is accomplished concurrently with bleaching. Where the dye image is not readily viewable in the photographic element, as where the dye within the image pattern is differentiated from background dye primarily by mobility, a separate step of transferring the image-dye pattern to a receiver sheet, as in conventional image transfer, is contemplated. Alternatively or additionally, where mobile dye is removed by transfer or washing, the image formed by retained immobile dye can be viewed.

The formation of photographic dye images through the use of a peroxide oxidizing agent in the sequential mode of practicing my process is particularly surprising. Whereas it is known in the art to employ a photographic silver image to catalyze an amplification reaction between a peroxide oxidizing agent and a dye-image-generating reducing agent, in this circumstance it is to be noted that the silver image can be entirely bleached before the photographic element being processed ever reaches the amplification bath. Thus, it is surprising that image amplification occurs at all. The sequential mode of practicing my process illustrates that a new catalyst is formed in the bleaching bath, namely, the cobalt(II) reaction product, which is retained in the silver image pattern and which catalyzes the subsequent amplification reaction. The sequential mode of practicing my process thus clearly illustrates certain novel aspects of my process.

In another mode of practicing my process, hereinafter referred to as a combined mode, the bleaching and amplification steps can be accomplished in a combined bleaching and amplification bath. In a simple form, this can be accomplished merely by adding one or more peroxide oxidizing agents of the type and in the concentrations described above to one of the bleaching baths described above. Since the dye-image-generating reducing agent, the cobalt(III) complex, and the silver salt-forming compound which is incapable of oxidizing image silver can be incorporated initially in at least some forms within the element bearing the photographic silver image, the only essential feature of the combined amplification and bleaching bath is an aqueous alkaline solution containing the peroxide oxidizing agent. However, it is preferred that at least the cobalt(III) complex and the peroxide oxidizing agent both be present in the combined bleaching and amplification bath in practicing my process in its combined mode. Since the cobalt(III) complex, which can be an oxidizing agent, and the dye-image-generating reducing agent must be brought into contact in practicing the combined bleaching and amplification process mode, it is required that the cobalt(III) complex and the dye-image-generating reducing agent be selected so that they are inert to oxidation-reduction reaction in the absence of a catalyst.

In a specific preferred form, the combined bleaching and amplification bath is comprised of an aqueous alkaline solution having a pH of at least 8, preferably in the range of from 10 to 13, with the activators described above being relied upon to adjust and control alkalinity. In addition, the combined bath contains at least one dye-image-generating reducing agent, peroxide oxidizing agent, cobalt(III) complex which permanently releases ligands upon reduction, and silver salt-forming compound which is incapable of oxidizing image silver. In one specifically contemplated form the silver salt-forming compound can provide a bromide ion concentration which is capable upon contact of poisoning the silver image so that it is ineffective as a catalyst for the redox reaction of the peroxide oxidizing agent and the dye-image-generating reducing agent. It is specifically contemplated that one or more color couplers can be present in the combined bleaching and amplification bath, although they are preferably incorporated, when used, in the photographic element being processed.

The combined mode of practicing my process using a combined bleaching and amplification bath retains the effectiveness of image-dye formation observed in the sequential mode, while concurrently simplifying my process from a manipulative viewpoint and permitting an incremental increase in dye-image generation. That the same mechanisms for dye-image generation are available in the combined mode as in the sequential mode is borne out, for example, by amplification being obtained even where the silver image is poisoned as a peroxide oxidizing agent redox catalyst. In addition to the dye-generating reactions available in the sequential mode, other chemical mechanisms for dye-image generation can also be at work. For example, I have observed that while the peroxide oxidizing agent is not itself a bleaching agent when employed alone, the combination of a peroxide oxidizing agent and a cobalt(III) complex in a bleaching bath or combined bleaching and amplification bath results in enhanced bleaching of the silver image. Thus, in its combined mode my process generally retains the advantages heretofore described in connection with the sequential mode and may allow denser dye images and/or more rapid dye-image formation, even though from a manipulative viewpoint the combined mode of my process is a simpler process to perform.

Where the photographic silver image contained in the element to be processed is formed from a latent image in a silver halide emulsion layer, my invention can be practiced in still another mode, hereinafter referred to as a monobath mode. In the monobath mode of practicing my invention, the steps of silver halide development, bleaching and amplification are accomplished in a single bath, hereinafter referred to as a monobath. Where at least one of the developing agents included within one of the developer baths employed in the sequential mode of practicing my process is also a dye-image-generating reducing agent, e.g., a color-developing agent, a monobath useful in the practice of my process can be formed merely by adding to the photographic developer a cobalt(III) complex which permanently releases ligands upon reduction a silver salt-forming compound (if not originally present in the developer) and a peroxide oxidizing agent, of the type and in the concentrations described above in connection with the sequential mode of practicing my process. In the monobath mode of practicing my invention, however, it is preferred that the concentration of compounds which will form multidentate ligands when complexed with cobalt be limited to less than a 0.05 molar, preferably less than a 0.01 molar, concentration. When the dye-image-generating reducing agent is not a color-developing agent, a monobath useful in the practice of my invention can be formed merely by adding a developing agent to the combined bleaching and amplification bath disclosed above in the combined mode of practicing my process. Where a combined mode bleaching and amplification bath contains a color-developing agent already as a dye-image-generating reducing agent, it can be employed without adding additional ingredients to process an element containing a photographic silver halide emulsion layer bearing a latent image according to the monobath mode of practicing my invention.

In a specific preferred form, the monobath employed in the practice of my process is comprised of an aqueous alkaline solution having a pH of at least 8, and preferably in the range of from 10 to 13, where the activators described above are relied upon to adjust and control alkalinity. In addition, the monobath contains at least one peroxide oxidizing agent. A dye-image-generating reducing agent can be incorporated within the monobath or within the photographic element. In a specific preferred form, the dye-image-generating reducing agent takes the form of a color-developing agent, such as a primary aromatic amine color-developing agent, incorporated within the monobath and used in combination with a color coupler incorporated within the photographic element being processed. At least one cobalt(III) complex which permanently releases ligands upon reduction is incorporated either within the monobath or the photographic element being processed. A silver salt-forming compound which is incapable of oxidizing image silver is included in the monobath or in the photographic element being processed. Other conventional photographic silver halide developer addenda, such as those described above in describing the developer composition, can also be included in the monobath. The monobath contains at least one developing agent. Where the dye-image-generating reducing agent takes the form of a redox dye-releaser, it is essential that the monobath incorporate a cross-oxidizing developing agent, which can be, or be in addition to, the silver halide developing agent. Where the dye-image-generating reducing agent is a color developing agent, a second, cross-oxidizing developing agent can be useful also. Since this mode or practicing my process brings into contact dye-image-generating reducing agents and/or silver halide developing agents, which are also reducing agents, and the peroxide oxidizing agents and the cobalt(III) complexes, which can be oxidized agents, it is required that the peroxide and cobalt(III) complex oxidizing agents and the reducing agents be chosen so that they are essentially inert to oxidation-reduction reaction in the absence of a catalyst,.

The monobath mode of practicing my process retains the effectiveness of image-dye formation observed in the sequential and combined modes of practicing my invention. It is believed that substantially the same reactions account for image-dye formation in the monobath mode as in the sequential and combined modes, although still additional alternative mechanisms for image-dye formation can be and, in most instances, are concurrently, active. Thus, the monobath mode of practicing my invention offers the advantages of requiring the fewest manipulative steps while allowing an enhanced dye image to be produced. My process of forming dye images employing a monobath is, for example, capable of producing a denser dye image in a given time period than can be produced using previously taught monobath processing relying on a cobalt(III) complex for amplification and lacking a peroxide oxidizing agent. Further, my process offers a distinct advantage in that image silver is not required to support the redox amplification reaction. Thus, my process can be practiced where the silver image is in a noncatalytic form. Since the silver image need not be relied upon to catalyze the redox amplification, it is further not necessary to retard silver image bleaching in order to prolong redox amplification. In my process, it is the immobile cobalt(II) reaction product of bleaching that is the catalyst for the redox amplification reaction involving the dye-image-generating reducing agent and the peroxide oxidizing agent. Hence, in my process accelerating bleaching will accelerate this redox amplification reaction. In addition, the monobath mode of practicing my process shares the advantages of the sequential and combined modes of processing more generally discussed above.

While I have employed the term "monobath" to describe the mode of practicing my process in which development, bleaching and amplification are all conducted in a single processing bath, it is to be recognized that additional processing baths can optionally be employed in the monobath mode of my process. For example, where silver halide development, bleaching and/or fixing is not carried to completion within the monobath, it is apparent that subsequent stop, fix and rinse steps of a conventional character can be employed to complete the processing of the photographic element.

For purposes of clarity I have described my invention in terms of three distinct processing modes, namely, a sequential mode, a combined mode and a monobath mode; however, these modes can be hybridized so that a particular process can partake of the features of two or more of the above process modes. For example, in the sequential mode, if a cobalt(III) complex is added to the amplification bath, further bleaching may occur in the amplification bath. Additionally, if a developing agent is added to the amplification and/or bleaching baths, additional development may occur in these baths even though development is primarily conducted in a prior developer bath. From the foregoing, it is apparent that the development, bleaching, fixing and amplification steps can be performed to varying degrees in the processing baths and that the reliance primarily upon a single bath as a development, bleaching or amplification bath does not foreclose this step from being performed also to a lesser degree in other processing baths.

In the foregoing description of my process it is apparent that oxidizing agents, the peroxide oxidizing agents and the cobalt(III) complexes, the reducing agents, the silver halide developing agents and the dye-image-generating reducing agents, will be brought into contact. Where these oxidizing and reducing agents are brought into contact, they must be essentially inert to oxidation-reduction in the absence of a catalyst, specifically, the coable(II) reaction product or the developed silver image. By "essentially inert to oxidation-reduction reaction in the absence of a catalyst" it is meant simply that the oxidizing agent and reducing agent combinations must be at least as unreactive in the absence of a catalyst as those combinations of these oxidizing and reducing agents which have been employed in conventional redox amplification systems of the type disclosed, for example, in U.S. Pat. Nos. 3,765,891; 3,822,129; 3,834,907; 3,847,619; 3,862,842; 3,923,511; 3,902,905; 3,674,490; 3,694,207; 3,765,890; 3,776,730; 3,817,761 and 3,684,511. In the combined development-amplification mode of practicing my process all of the above oxidizing and reducing agents can be in a single bath or the photographic element immersed therein so that they are in contact. However, in the sequential mode of practicing my process only the cobalt(III) complex and reducing agent in the first amplification bath and the peroxide oxidizing agent and the dye-image-generating reducing agent in the second amplification bath need be in contact, as among the above oxidizing and reducing agents. In this instance it is immaterial if the cobalt(III) complex, for example, which is in the first amplification bath, will spontaneously react with a dye-image-generating reducing agent or silver halide developing agent, which are confined to one or more separate baths. Stated, more generally, it is apparent that the above oxidizing and reducing agents which are brought into contact must be essentially inert to oxidation-reduction in the absence of a catalyst, but where the materials are not brought into contact, no such restriction on the selection of oxidizing and reducing agents is necessary.

The photographic elements processed according to my invention can take a variety of conventional forms. In a simple form, the photographic element to be processed can be comprised of a conventional photographic support, such as disclosed in *Product Licensing Index,* Vol. 92, December, 1971, publication 9232, paragraph X, bearing a photographic silver image. In those forms of my process which do not include the step of developing the photographic silver image, the method or approach for producing the photographic silver image is immaterial to the practice of my invention and any conventional photographic silver image can be employed.

In a preferred form of my invention, the photographic elements to be processed are comprised of at least one photographic silver halide emulsion layer which either bears the photographic silver image or is capable of forming a photographic silver image. I specifically contemplate the processing of photographic elements containing at least one photographic silver halide emulsion layer which upon imagewise exposure to actinic radiation (e.g., ultraviolet, visible, infrared, gamma or X-ray electromagnetic radiation, electron-beam radiation, neutron radiation, etc.) is capable of forming a developable latent image. The silver halide emulsions employed to form useful emulsion layers include those disclosed in *Product Licensing Index,* publication 9232, cited above, paragraph I, and these emulsions can be prepared, coated and/or modified as disclosed in paragraphs II through VIII, XII, XIV through XVIII and XXI. The photographic elements to be processed according to my process can, of course, incorporate a cobalt(III) complex, a silver salt-forming moiety that is incapable of oxidizing image silver (such as a silver halide solvent), a color coupler and/or one or more developing agents, if desired, as indicated above in the discussion of my process.

The cobalt(III) complexes when incorporated in the photographic elements to be processed are preferably present as water-insoluble ion-pairs. The use of water-insoluble ion-pairs of cobalt(III) complexes is described more fully in Bissonette et al U.S. Pat. No. 3,847,619, cited and incorporated by reference above. Generally, these ion-pairs comprise a cobalt(III) ion complex ion-paired with an anionic organic acid having an equivalent weight of at least 70 based on acid groups. Preferably, the acid groups are sulfonic acid groups. The photographic elements generally contain at least 0.1 $mg/dm^2$ of cobalt in each silver halide emulsion layer unit, and preferably from 0.2 to 5.0 $mg/dm^2$. The term "layer unit" refers to one or more layers intended to form a dye image. In a multicolor photographic element containing three separate image dye-providing layer units, the element contains at least 0.3 $mg/dm^2$ (0.1 $mg/dm^2$ per layer unit) and preferably 0.6 to 15.0 $mg/dm^2$ of cobalt in the form cobalt(III) ion complex ion-paired with an anionic organic acid.

In certain preferred embodiments, the couplers incorporated in the photographic elements being processed are water-insoluble color couplers which are incorporated in a coupler solvent which is preferably a moderately polar solvent. Typical useful solvents include tri-o-cresyl phosphate, di-n-butyl phthalate, diethyl lauramide, 2,4-diarylphenol, liquid dye stabilizers as described in an article entitled "Improved Photographic Dye Image Stabilizer-Solvent", *Product Licensing Index,* Vol. 82, pp. 26–29, March, 1971, and the like.

In certain highly preferred embodiments, the couplers are incorporated in the photographic elements by dispersing them in a water-miscible, low-boiling solvent having a boiling point of less than 175° C and preferably less than 125° C, such as, for example, the esters formed by aliphatic alcohols and acetic or propionic acids, i.e., ethyl acetate, etc. Typical methods for incorporating the couplers in photographic elements by this technique and the appropriate solvents are disclosed in U.S. Pat. Nos. 2,949,360, column 2, by Julien; 2,801,170 by Vittum et al.; and 2,801,171 by Fierke et al.

Color couplers can also be incorporated into the photographic elements that are useful in the practice of my invention by blending them into the photographic emulsions in the form of latexes, called "coupler-loaded" latexes. Coupler-loaded latexes are polymeric latexes into the particles of which has been blended the coupler(s). Coupler-loaded latexes can be prepared in accordance with the process of Chen, which is described in U.S. patent application Ser. No. 575,689, filed May 8, 1975. This disclosure is incorporated by reference into the present application. Briefly, this process involves (1) dissolution of the coupler into a water miscible organic solvent, (2) blending into the resulting solution a selected aqueous loadable latex, and (3) optionally removing the organic solvent, for example by evaporation thereof.

In one specific preferred form, the photographic elements to be employed in the practice of my process can comprise a support having thereon at least one image dye-providing layer unit containing a light-sensitive silver salt, preferably silver halide, having associated therewith a stoichiometric excess of coupler of at least 40% and preferably at least 70%. The equivalency of color couplers is known in the art; for example, a 4-equivalent coupler requires 4 moles of oxidized color developer, which in turn requires development of 4 moles of silver, to produce 1 mole of dye. Thus, for a stoichiometric reaction with silver halide, 1-equivalent weight of this coupler will be 0.25 mole. In accordance with this invention, the color image-providing unit comprises at least a 40% excess of the equivalent weight of image dye-providing color coupler required to react on a stoichiometric basis with the developable silver and preferably a 70% excess of said coupler. In one highly preferred embodiment, at least a 110% excess of the coupler is present in said dye image-providing layers based on silver. The ratio can also be defined as an equivalent excess with a coupler-to-silver ratio of at least 1.4:1, and preferably at least 1.7:1 (i.e., 2:1 being a 100% excess). In certain preferred embodiments, the photographic color couplers are employed in the image dye-providing layer units at a concentration of at least 3 times, such as from 3 to 20 times, the weight of the silver in the silver halide emulsion, and the silver is present in said emulsion layer at up to 30 mg silver/ft$^2$ (325 mg/m$^2$). Weight ratios of coupler-to-silver coverage which are particularly useful are from 4 to 15 parts by weight coupler to 1 part by weight silver. Advantageously, the coupler is present in an amount sufficient to give a maximum dye density in the fully processed element of at least 1.7 and preferably at least 2.0. Preferably, the difference between the maximum density and the minimum density in the fully processed element (which can comprise unbleached silver) is at least 0.6 and preferably at least 1.0.

The light-sensitive silver salt layers used in elements processed in accordance with this invention are most preferably at silver coverages of up to about 30 mg silver/ft$^2$ (325 mg/m$^2$), such as from 0.1 to 30 mg/ft$^2$ (1.0–325 mg/m$^2$) and more preferably from about 1 to 25 mg silver/ft$^2$ (10–270 mg/m$^2$). Especially good results are obtained with coverages on the order of from about 2 to 15 mg/ft$^2$ of silver (20–160 mg/m$^2$) for the green- and red-sensitive layers in typical multilayer color films.

It is realized that the density of the dye may vary with the developing agent combined with the respective coupler, and accordingly the quantity of coupler can be adjusted to provide the desired dye density. Preferably, each layer unit contains at least $1 \times 10^{-6}$ moles/dm$^2$ of color coupler when color couplers are employed.

Advantageously, the photographic color couplers utilized are selected so that they will give a good neutral dye image. Preferably, the cyan dye formed has its major visible light absorption between about 600 and 700 nm (that is, in the red third of the visible spectrum), magenta dye has its major absorption between about 500 and 600 nm (that is, in the green third of the visible spectrum), and the yellow dye has its major absorption between about 400 and 500 nm (that is, in the blue third of the visible spectrum). Particularly useful elements comprise a support having coated thereon red-, green- and blue-sensitive silver halide emulsion layers containing, respectively, cyan, magenta and yellow photographic color couplers.

The light-sensitive silver salts are generally coated in the color-providing layer units in the same layer with the photographic color coupler. However, they can be coated in separate adjacent layers as long as the coupler is effectively associated with the respective silver halide emulsion layer to provide for immediate dye-providing reactions to take place before substantial color-developer oxidation reaction products diffuse into adjacent color-providing layer units.

Where an initially immobile dye-image-generating reducing agent is employed, it is initially present within the photographic element. Redox dye-releasers (RDR's) constitute a preferred class of initially immobile dye-image-generating reducing agents. Suitable redox dye-releaser containing photographic elements useful in the practice of my process can be formed by substituting RDR's for the incorporated color couplers in the photographic elements described above. In a multilayer photographic element intended to form a multicolor image one or more RDR's capable of releasing a yellow dye are incorporated in the blue recording emulsion layer or in a separate processing solution permeable layer adjacent thereto at a concentration of from about 0.5 to 8 percent by weight based on the total weight of the emulsion layer. The layer adjacent the emulsion layer is typically a hydrophilic colloid layer, such as a gelatin layer. In a similar manner one or more RDR's are also associated with the green and red recording emulsion layers capable of releasing magenta and cyan dyes, respectively. Single color, single RDR-containing photographic elements are, of course, useful as well as multicolor elements.

Exemplary of specifically preferred RDR's are those of the sulfonamide type, which may be represented by the following general formula:

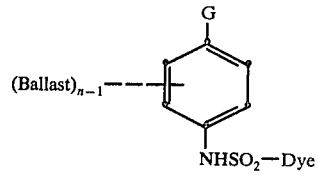

(I)

wherein:

(1) Dye is a dye or dye precursor moiety;

(2) Ballast is an organic ballasting radical of such molecular size and configuration (e.g., simple organic groups or polymeric groups) as to render the compound nondiffusible during development in an alkaline processing composition;

(3) G is OR or NHR$_1$ wherein R is hydrogen or a hydrolyzable moiety and R$_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc., (when R$_1$ is an alkyl group of a greater than 6 carbon atoms, it can serve as a partial or sole Ballast group); and (4) $n$ is a positive integer of 1 to 2 and is 2 when G is OR or when R$_1$ is hydrogen or an alkyl group of less than 8 carbon atoms.

In addition to Ballast, the benzene nucleus in the above formula may have groups or atoms attached thereto such as the halogens, alkyl, aryl, alkoxy, aryloxy, nitro, amino, alkylamino, arylamino, amido, cyano, alkylmercapto, keto, carboalkoxy, heterocyclic groups, etc. In addition, such groups may combine together with the carbon atoms to which they are attached on the ring to form another ring which may be saturated or unsaturated including a carbocyclic ring, a heterocyclic ring, etc. Preferably an aromatic ring is directly fused to the benzene nucleus which would form, for example, a naphthol. Such a p-sulfonamidonaphthol is considered to be a species of a p-sulfonamidophenol and thus included within the definition. The same is true for p-sulfonamidoanilines of the invention.

Exemplary hydroquinone-type RDR's which can be used according to this invention are represented by the following formula:

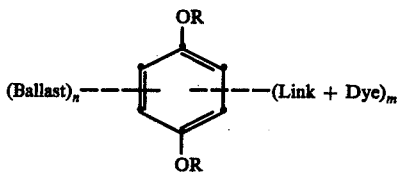

(II)

wherein:

(1) each R represents hydrogen or a hydrolyzable moiety;
(2) Ballast is a photographically inert organic ballasting radical of such molecular size and configuration as to render the alkali-cleavable compound nondiffusible during development in an alkaline processing composition;
(3) Dye is a dye or dye precursor;
(4) Link is a S, O, or $SO_2$ linking group;
(5) $n$ is an integer of 1 to 3; and
(6) $m$ is an integer of 1 to 3.

The nature of the ballast group (Ballast) in the formula for the compounds described above is not critical as long as it confers nondiffusibility to the compounds. Typical ballast groups include long-chain alkyl radicals linked directly or indirectly to the compound as well as aromatic radicals of the benzene and naphthalene series indirectly attached or fused directly to the benzene nucleus, etc. Useful ballast groups generally have at least 8 carbon atoms such as a substituted or unsubstituted alkyl group of 8 to 22 carbon atoms, an amide radical having 8 to 30 carbon atoms, a keto radical having 8 to 30 carbon atoms, etc.

As previously mentioned, Dye in the above formula represents a dye or dye precursor moiety. Such moieties are well known to those skilled in the art and include dyes such as zero, azomethine, axopyrazolone, indoaniline, indophenol, anthraquinone, triarylmethane, alizarin, metal complexed dyes, etc., and dye precursors such as a leuco dye, a "shifted" dye which shifts hypsochromically or bathochromically when subjected to a different environment such as a change in pH, reaction with a material to form a complex, etc. Dye could also be a coupler moiety such as a phenol, naphthol, indazolone, open-chain acetanilide, pivalylacetanilide, malonamide, malonanilide, cyanoacetyl, coumarone, pyrazolone, compounds described in U.S. Pat. No. 2,765,142, etc. These compounds may contain a solubilizing group if desired. Examples of such dye groups include the following:

YELLOW DYE GROUPS

YDG-1 4-Hydroxy azophenylphenylene

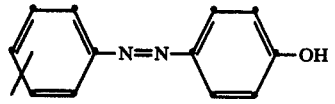

YDG-2 3-Methyl-4-hydroxyazophenylphenylene

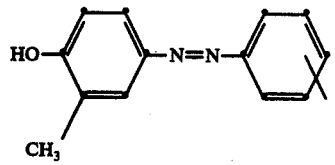

YDG-3

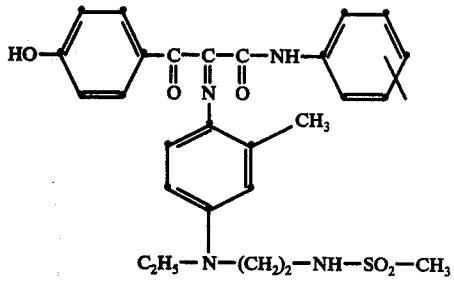

YDG-4 p-Sulfhydrylazophenylphenylene

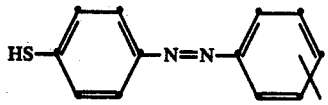

YDG-5

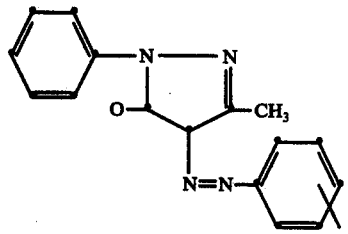

YDG-6

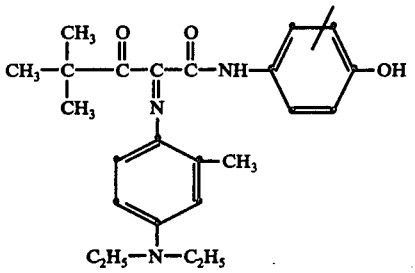

YDG-7

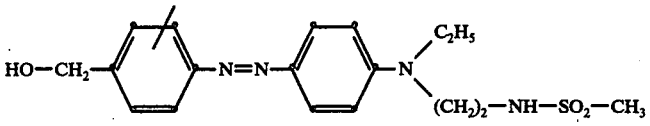

MAGENTA DYE GROUPS

MDG-1

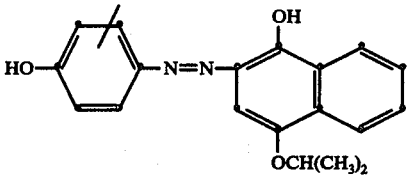

MDG-2

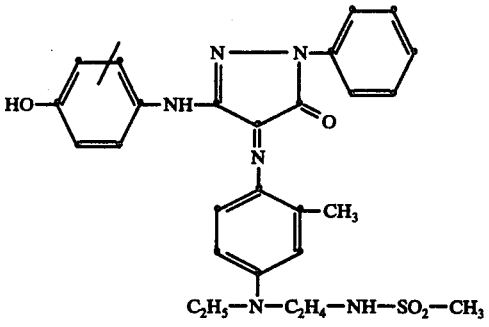

CYAN DYE GROUPS

CDG-1

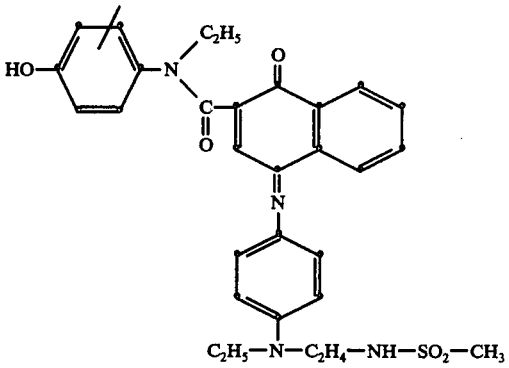

CDG-2

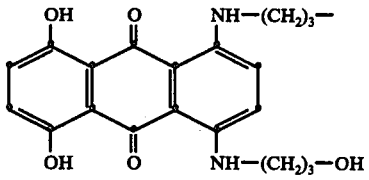

When dye precursor moieties are employed in the RDR's instead of dyes, they are converted to dyes by means well known to those skilled in the art, e.g., oxidation, either in the photosensitive element, in a processing composition or in a dye image-receiving layer to form a visible dye. Such techniques are disclosed, for example, in British Pat. Nos. 1,157,501; 1,157,502; 1,157,503; 1,157,504; 1,157,506; 1,157,507; 1,157,508; 1,157,509; 1,157,510; and U.S. Pat. Nos. 2,774,668; 2,698,798; 2,698,244; 2,661,293; 1,559,643; etc.

My process can be practiced with photographic elements of the color diffusion transfer type. In a simple application of my invention, a monobath according to my invention can be substituted for the processing composition employed in a conventional color image transfer element. It is specifically contemplated that my process can be practiced with either "peel-apart" or integral color diffusion transfer photographic elements. The sequential and combined modes of practicing my invention can be readily employed with peel-apart-type color image transfer elements. In most instances, where successive processing compositions are to be brought into contact with the photographic element, a receiver element capable of receiving and mordanting a transferred dye image ca be brought into contact with the photographic element after amplification is complete. Typical color image transfer elements useful in conjunction with my process include Rogers U.S. Pat. Nos. 2,774,668 and 2,983,606, cited above; Weyerts U.S. Pat. No. 3,146,102 (issued August 25, 1974; Barr et al. U.S.

Pat. Nos. 3,227,551 and 3,227,554 (issued Jan. 4, 1966); Whitmore et al. U.S. Pat. No. 2,337,550 (issued Jan. 4, 1966); Whitmore U.S. Pat. No. 3,227,552 (issued Aug. 27, 1964); Land U.S. Pat. Nos. 3,415,644, 3,415,645 and 3,415,646 (issued Oct. 16, 1973); as well as Canadian Pat. No. 602,607, U.S. Ser. No. B351,673; Belgian Pat. No. 788,268; and U.S. Pat. Nos. 3,698,897; 3,728,113, 3,725,062; 3,443,939; 3,443,940, and 3,443,941, each cited above.

Where my process is applied to color diffusion transfer type elements and processes, it is appreciated that the dye image which is produced may not be visually discernable within the layer in which it is formed, since it may not chromophorically differ from other layer components, but may differ in terms of relative mobility. The dye image of alterred mobility can be employed to form a visible image by selectively transferring either the dye image or the chromophorically similar layer component to a receiver for viewing. As is well understood in the color diffusion transfer imaging, conventional chromophoric layer components can be initially mobile and immobilized when oxidized or initially immobile and rendered mobile by oxidation. In addition to color developing agents and color couplers which form dyes upon reaction, chromophoric components wherein the chromophoric unit is preformed, such as dye developers and redox dye-releasers, have been widely used in color diffusion transfer imaging. The preferred chromophoric components for use in a color diffusion transfer method according to my invention are redox dye-releasers which are initially immobile and which are rendered sufficiently mobile for diffusion transfer to a receiver for viewing upon reaction with an oxidized silver halide developing agent followed, in some instances, by alkaline hydrolysis.

The photographic element employed in the practice of my process can, if desired, initially contain one or more compounds capable of forming multidentate ligands with cobalt. The presence of such compounds in the photographic element during development can enhance maximum dye image densities, as described above. Such compounds can be leached or otherwise removed from the photographic element prior to bleaching, so that the preferred low levels of multidentate ligand-forming compounds are present during that step. I prefer that the photographic elements initially contain low levels or no multidentate ligand-forming compounds, particularly where the photographic element is to be employed in the monobath mode of practicing my invention; however, any alternative approach which insures the desired low concentrations of multidentate ligand-forming compounds during the bleaching step can be advantageously employed.

EXAMPLES

The practice of my invention ca be better appreciated by reference to the following examples:

EXAMPLE 1

A Sequential Mode

A. A photographic element having a paper support and capable of forming multicolor images was formed by coating gelatino-silver halide emulsion layers set forth below in Table I. Unless otherwise stated, all coating densities in the examples are reported parenthetically in terms of mg/0.093 meter$^2$ (i.e., mg/ft$^2$). Silver halide coating densities are reported in terms of silver. All silver image characteristic curves are those obtained by exposure of the red sensitive layer of each element. Unless otherwise stated, all processing was conducted at 24° C.

Table I

| Photographic Element 1-A |
|---|
| Gelatin (100) |
| Red-Sensitive Layer: Red-Sensitized Silver Halide (6); Gelatin (90); Coupler Solvent Di-n-butyl phthalate (17.5); Coupler 2-[α-(2,4-Di-tert-amylphenoxy) butyramido-4,6-dichloro-5-methylphenol (35) |
| Gelatin (160); 3,5-Di-tert-octylhydroquinone (4.5) |
| Green-Sensitive Layer: Green-Sensitized Silver Halide (10); Gelatin (132); Coupler solvent Tricresyl phosphate (12.5); Coupler 1-(2,4,6-Trichlorophenyl)-3-{5-[α-(3-tert-butyl-4-hydroxyphenoxy)tetradecaneamido]-2-chloroanilino}-5-pyrazolone (25) |
| Gelatin (100); 3,5-Di-tert-octylhydroquinone (5.0) |
| Blue-Sensitive Layer: Silver Halide (16); Gelatin (122); Coupler Solvent Di-n-butyl phthalate (15); Coupler α-Pivalyl-4-(4-benzyloxyphenylsulfonyl) phenoxy-2-chloro-5-[γ-(2,4-di-tert-amylphenoxy)-butyramido]acetanilide (60) |
| Paper Support |

B. A first sample of the photographic element was exposed with red, green and blue light sources each focused on a separate portion of the element through a graduated-density test object having 21 equal density steps ranging from 0 density at Step 1 to a density of 3.0 at Step 21. The exposed sample was then developed for 1 minute in a black-and-white developer containing hydroquinone and N-methyl-p-aminophenol sulfate as developing agents and of the type employed in the Ektachrome E4 process described in *The British Journal of Photography Annual* (1973), pp. 208–210. Development was stopped for 1 minute in a 1% aqueous solution of acetic acid, fixed for 1 minute in Kodak F-5 fix solution, washed for 1 minute, and then dried. A characteristic curve representing the infrared density of the image silver contained in the red-sensitive layer of the sample is plotted as curve A in FIG. 1. No dye image was formed.

C. A second sample identical to that of paragraph 1-A above was similarly exposed, developed and examined as in paragraph 1-B. The second sample was washed for one minute with water at room temperature and then placed in the bleach-fix bath of Table II for 4 minutes. Thereafter the washing step was repeated and the sample allowed to dry.

Table II

| Bleach-Fix Bath | |
|---|---|
| $Na_2SO_3$ | 8 g |
| $Na_2CO_3$ | 20 g |
| $Na_2S_2O_3$ | 80 g |
| KBr | 2 g |
| Benzyl alcohol | 10 ml |
| $[Co(NH_3)_6]Ac_3$ | 4 g |
| 30% (by weight) $H_2O_2$ in water | 10 ml |
| Water to 1 liter | (pH 11.0) |

The curve B in FIG. 1 shows that the silver image was removed by bleaching and that the cobalt(II) reaction product forming the catalyst image for amplification exhibited only a negligible density. No dye image was formed.

D. A third sample identical to that of paragraph 1-A was exposed, processed and examined according to the procedure of paragraph 1-C. The third sample was thereafter treated for 4 minutes in an amplifier bath of the composition set out in Table III.

Table III

| Amplification Bath | |
|---|---|
| Benzyl alcohol | 10.0 ml |
| $Na_2SO_3$ | 8.0 g |
| Color-Developing Agent (CDA-1) N-Ethyl-β-methanesulfonamidoethyl-3-methyl-4-aminoaniline sulfate | 4.0 g |
| $Na_2CO_3$ | 20.0 g |
| KBr | 2.0 g |
| 30% (by weight) $H_2O_2$ in water | 10.0 ml |
| Water to 1 liter | (pH 11.0) |

The characteristic curve C shown in FIG. 1 shows the density of cyan dye formed in the red-sensitive silver halide layer of the sample. Since the silver image had been bleached from the sample before any color-developing agent was present, the dye density must be attributed to the catalytic effect of the cobalt(II) reaction product remaining imagewise distributed in the sample during the amplification step.

It is believed that image-dye generation can be accounted for by the following reactions, wherein the first reaction occurred in the bleach-fix bath and the remaining three reactions occurred in the amplification bath:

(a) $Ag^{\circ} + [Co(NH_3)_6]^{+3} + 2(S_2O_3)^{-2} \rightarrow Co(II) + Ag(S_2O_3)_2^{-3} + 6NH_3$ (b) $2Co(II) + H_2O_2 \rightarrow 2Co(III) + 2OH^-$ (c) $Co(III) + \text{Col. Dev.} \rightarrow Co(II) + \text{Col. Dev.}_{ox.}$ (d) $\text{Col. Dev.}_{ox} + \text{Coupler} \rightarrow$ IMAGE DYE E. A result similar to that of paragraph 1-D was obtained when a fourth sample, identical to that of paragraph 1-D, was exposed, processed and examined similarly as in paragraph 1-D, but with the hydrogen peroxide omitted from the bleach-fix bath. Although the results were qualitatively similar to those of paragraph 1-D, the bleach-fix rate was somewhat slower without the hydrogen peroxide present in the bleach-fix bath.

In the foregoing lettered paragraphs 1-D and 1-E, the dye image of only the red-sensitive emulsion layer is reported; however, the dye images formed in each of the emulsion layers showed generally similar results.

EXAMPLE 2

A Combined Mode — With and Without a Stop Bath

A. A photographic element was prepared similar to that of paragraph 1-A above, except that different concentrations of ingredients were employed. The concentrations are set out below in Table IV.

Table IV

| Photographic Element 2-A |
|---|
| Gelatin (100) |
| Red-Sensitive Layer: Red-Sensitized Silver Halide (17.5); Gelatin (135); Coupler Solvent (20); Coupler (40) |
| Gelatin (162); 3,5-Di-tert-octylhydroquinone (10) |
| Green-Sensitive Layer: Green-Sensitized Silver Halide (22.5); Gelatin 224); Coupler (49); Coupler Solvent (24) |
| Gelatin (100); 3,5-Di-tert-octylhydroquinone (10) |
| Blue-Sensitive Layer: Silver Halide (30); Gelatin (160); Coupler (109); and Coupler Solvent (10) |

Table IV-continued

| Photographic Element 2-A |
|---|
| Paper Support |

Figure 2:
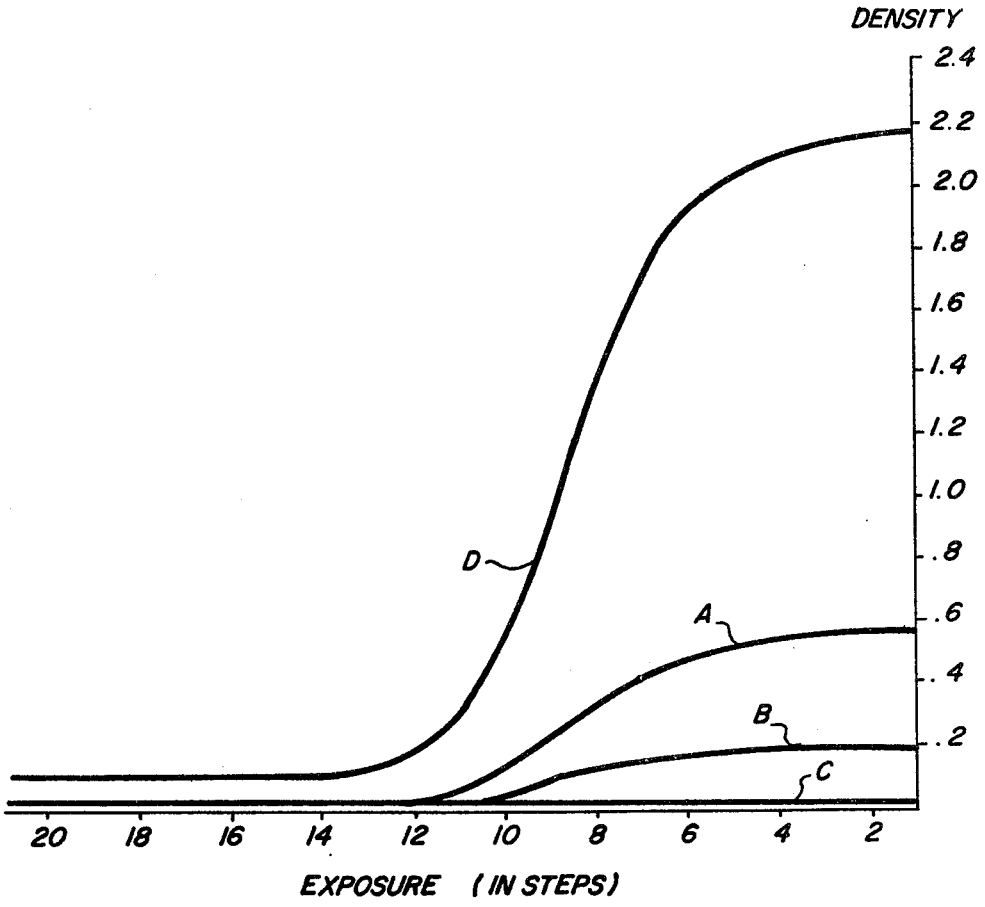
FIG. 2 is a plot of a cyan dye image and three silver image characteristic curves for red-sensitized silver halide emulsion layers.

B. A first sample of the photographic element was exposed, processed and examined as in paragraph 1-B. A characteristic curve representing the infrared density of the image silver contained in the red-sensitive layer of the sample is plotted as curve A in FIG. 2. No dye image was formed.

C. A second sample was exposed, processed and examined as in paragraph 2-B, except that a combined bleach-fix and amplification bath was substituted for the fixing step using Kodak F-5 fixing solution. The bleach-fix and amplification bath was of the composition set forth below in Table V and lacked either a peroxide oxidizing agent or a cobalt(III) complex. The bath is accordingly referred to as a blank bleach-fix and amplification bath. The result obtained was a characteristic curve identical to curve A in FIG. 2.

Table V

| Blank Bleach-Fix and Amplification Bath | |
|---|---|
| $Na_2S_2O_3$ | 40.0 g |
| KBr | 2.0 g |
| $Na_2SO_3$ | 8.0 g |
| Color-Dev. Agent (CDA-1) | 4.0 g |
| $Na_2CO_3$ | 20.0 g |
| Water to 1 liter | (pH 11.0) |

Since no bleaching agent was present in the blank bleach-fix and amplification bath, only fixing was obtained. The conformity of the silver image characteristic curves shows that no bleachig occurred. No dye image was formed.

D. A third sample was exposed, processed and examined as in paragraph 2-C, except that 10 ml of a 30% by weight aqueous solution of hydrogen peroxide were added to the blank bleaching and fixing bath. The resulting silver image characteristic curve for the red sensitive layer was identical to that of curve A in FIG. 2, indicaing that no bleaching of the silver image occurred as a result of introducing the peroxide oxidizing agent. The sample further contained no dye image. The absence of a dye image indicated that the silver image was not acting as a catalyst for the redox amplification of the color-developing agent and the peroxide oxidizing agent.

E. A fourth sample was exposed, processed and examined as in paragraph 2-C, except that 4 grams of cobalt hexammine acetate, a cobalt(III) complex containing mobile ligands, were added to the blank bleaching and fixing bath. No dye image was formed, but the silver image was bleached, as indicated by the silver image characteristic curve B in FIG. 2.

F. A fifth sample was exposed, processed and examined as in paragraph 2-C, except that 10 ml of a 30% by weight aqueous solution of hydrogen peroxide and 4 grams of cobalt hexammine acetate were added to the blank bleaching and fixing bath. The silver image was completely bleached, as indicated by the characteristic curve C in FIG. 2. At the same time yellow, magenta and cyan dye images were formed in the silver halide emulsion layers. The characteristic curve for the cyan dye image formed in the red-sensitive emulsion layer is represented by curve D in FIG. 2. The image dyes in the two remaining emulsion layers showed generally similar characteristics. It is believed that the dye image in the combined mode was formed by a sequence of reactions similar to that set forth above in paragraph 1-D in describing the sequential mode. It is also possible in the combined mode that some dye was formed by the silver image catalyzing some of the cobalt(III) complex to enter into a redox amplification reaction with a portion of the color-developing agent, which in turn upon oxidation reacted with a portion of the coupler.

Figure 3:
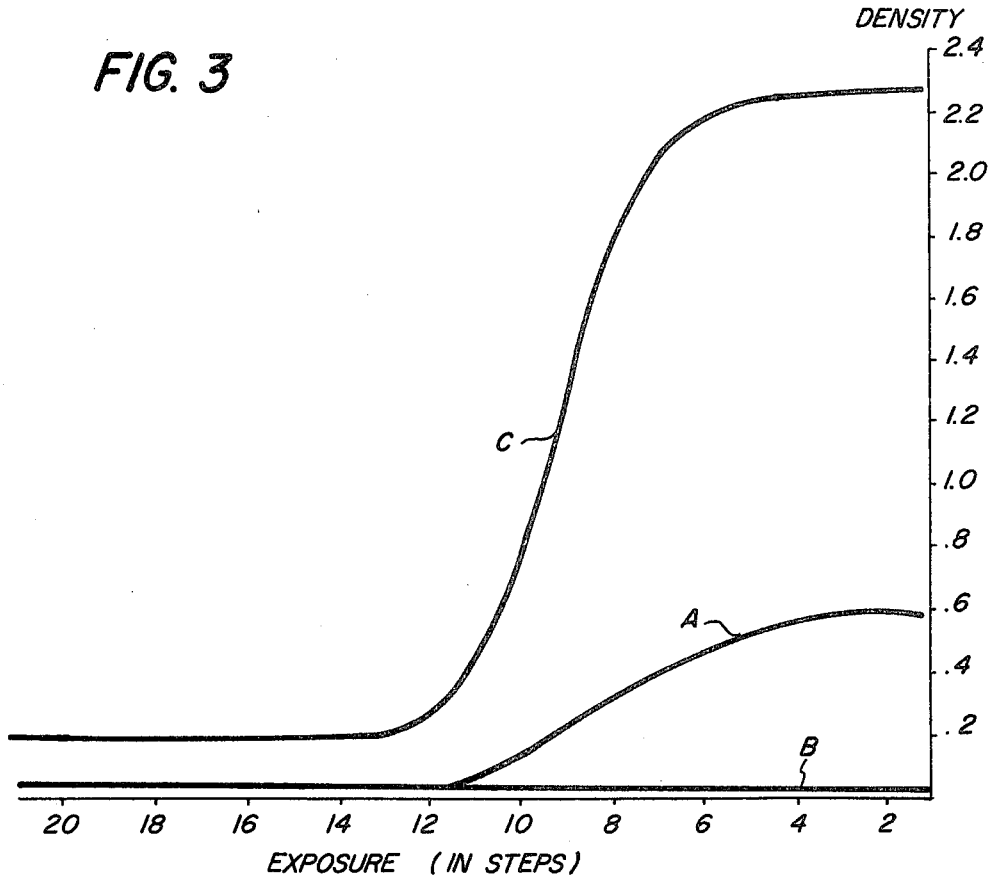

G. Samples of the photographic element of paragraph 2-A were used to repeat the procedures of paragraphs A through F, but with the modification that the stop bath between development and the combined bleach-fix and amplification bath was omitted. The results can be summarized by reference to FIG. 3. Curve A in FIG. 3 is the silver image infrared absorption characteristic curve of the red-sensitive layer obtained using a stop bath between the developer and fixing baths as in paragraph 2-B. The same characteristic curve was also obtained when the stop bath was omitted and the fix bath concurrently replaced with the blank bleach-fix and amplification bath. The same result was also obtained when the peroxide oxidizing agent was aadded to the blank bleach-fix and amplification bath with the stop bath omitted. No dye image was formed in any of these instances. Curve B in FIG. 3 shows the silver image infrared absorptiion characteristic curve obtained when the cobalt hexammine acetate was added to the blank bleaching and fixing bath with the stop bath being omitted. Curve B also represents the silver image characteristic curve obtained with both the peroxide and cobalt hexammine acetate present in the combined bleach-fix and amplification bath with the stop bath being omitted. Curve C is the cyan dye image characteristic curve obtained with both the peroxide oxidizing agent and cobalt(III) complex present in the combined bleach-fix and amplification bath and the stop bath being omitted. Generally similar dye images of magenta and yellow were formed in the remaining two emulsion layers.

EXAMPLE 3

A Combined Mode — Using a Color-Developing Agent to Develop Silver

Figure 4:
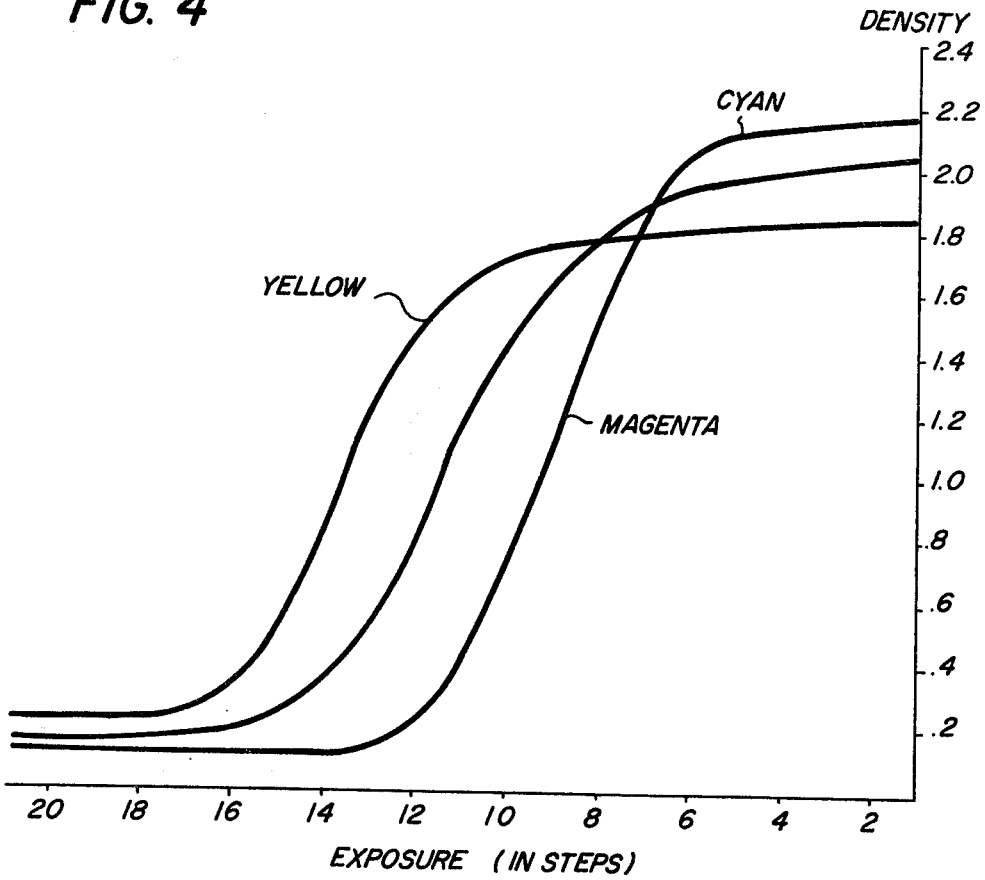

A. A photographic element as described in paragraph 1-A was exposed as described in paragraph 1-B. The photographic element was color-developed for 1 minute in a developer bath of the composition set forth in Table VI. The photographic element was then placed for 45 seconds in a combined bleach-fix and amplification bath of the composition of paragraph 2-F, that is, of the composition of the blank bleach-fix and amplification bath of Table V with 10 ml of 30 % by weight hydrogen peroxide and 4 grams of cobalt hexammine acetate being additionally present. The photographic element was then placed in a 1% aqueous solution of acetic acid stop bath for 1 minute, washed with water for 1 minute and dried. The characteristic curves of the cyan, magenta and yellow dye images formed are shown in FIG. 4.

Table VI

| Color-Developer Bath | |
|---|---|
| Benzyl alcohol | 10.0 ml |
| $Na_2SO_3$ | 2.0 g |
| Col.-Dev. Agent (CDA-1) | 10.0 g |
| $Na_2CO_3$ | 20.0 g |
| KBr | 1.0 g |
| Water to 1 liter | (pH 11.0) |

EXAMPLE 4

A COMBINED MODE — USING BROMIDE IONS FOR BLEACHING

A. A sample of a photographic element as described in paragraph 1-A was exposed as described in paragraph 1-B. The exposed sample was then developed for 2 minutes in black-and-white developer Kodak D-19 (which incorporates a mixture of hydroquinone and para-methylaminophenol sulfate developing agents) and then placed in a blank bleaching and amplification bath of the composition set out in Table VII for 2 minutes.

Table VII

| Blank Bleaching and Amplification Bath | |
|---|---|
| $Na_2SO_3$ | 4.0 g |
| Benzyl alcohol | 10.0 ml |
| Col.-Dev. Agent (CDA-1) | 5.0 g |
| $Na_2CO_3$ | 40.0 g |
| KBr | 25.0 g |
| $H_2O$ to 1 liter (pH 12.5) | |

The sample was then placed in a conventional bleach-fix bath of the composition set out in Table VIII for 2 minutes.

Table VIII

| Bleach-Fix Bath | |
|---|---|
| Diaminopropanol tetraacetic acid | 3 g |
| Acetic acid | 20 ml |
| $(NH_4)_2S_2O_3$ (60% by weight aqueous solution) | 150 ml |
| $Na_2SO_3$ | 15 g |
| $[Co(NH_3)_6]Cl_3$ | 3 g |
| Water to 1 liter (pH 4.5) | |

The sample was then washed with water for 2 minutes, placed in a stabilization bath of the composition set forth in Table IX for 1 minute, washed with water again for 1 minute and then allowed to dry.

Table IX

| Stabilization Bath | |
|---|---|
| KOH (45% by weight solution) | 5.97 g |
| Benzoic acid | 0.34 g |
| Acetic acid | 13.1 g |
| Citric acid | 6.25 g |
| Water to 1 liter (pH 3.5) | |

The processed sample contained neither a silver nor a dye image. From visual inspection during processing, it was observed that the silver image formed during black-and-white development was not removed in the blank bleaching and amplification bath. Both bleaching and fixing occurred in the bleach-fix bath.

B. A second sample identical to that of paragraph 4-A was similarly exposed, processed and examined, except that 4.0 grams of cobalt hexammine acetate were added to the blank bleaching and amplification bath. No silver nor dye image was obtained. It was visually observed during processing, however, that the silver image formed during black-and-white development was bleached in the modified blank bleaching and amplification bath. The conventional bleach-fix bath then functioned in this instance only to fix residual silver halide.

C. A third sample identical to that of paragraph 4-A was similarly exposed, processed and examined, except that 1.0 ml of a 30% by weight aqeueous solution of hydrogen peroxide was added to the blank bleaching and fixing bath. The same result was obtained as in paragraph -b 4-A. The peroxide oxidizing agent was not catalyzed by image silver to enter into a redox amplification reaction with the color-developing agent in the blank bleaching and amplification bath and did not bleach image silver.

Figure 5:
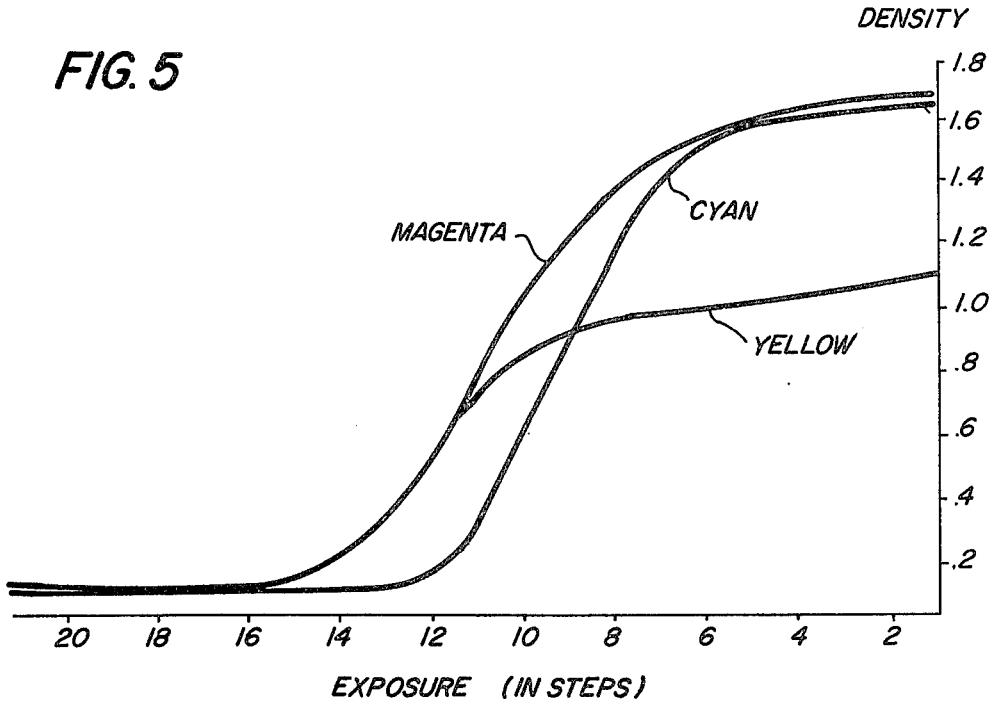
FIGS. 4 through 6 are in each instance characteristic curves for blue, green and red light-recording layers of a photographic element, wherein the blue layer characteristic curve is that produced by a yellow image dye, the green layer characteristic curve is that produced by a magenta image dye and the red layer characteristic curve is that produced by a cyan image dye.

D. A fourth sample identical to that of paragraph 1-A was similarly exposed, processed and examined, except that the blank bleaching and amplification bath was converted to an active bleaching and amplification bath through the addition of 1.0 ml of a 30% by weight aqueous solution of hydrogen peroxide and 4.0 grams of cobalt hexammine acetate. Cyan, magenta and yellow dye images were formed in the bleaching and amplification bath while the silver image was bleached completely in this bath. The characteristic curves produced by each of the cyan, magenta and yellow images dyes are shown in FIG. 5.

It is believed that image-dye formation can be accounted for by the following reactions occurring in the combined bleaching and amplification bath. The silver image is, of course, formed in the black-and-white development step preceding the combined bleaching and amplification step. If any residual silver remains after the sample is removed from the combined bleaching and amplification bath, it can be bleached in the bleach-fix bath while the silver halide originally present in the photographic element, as well as the silver bromide formed in the combined bath, is being fixed.

(a) $Ag^{\circ} + [CO(L)_6]^{+3} + Br_{-} \rightarrow AgBr + Co(II) + 6L$ (b) $2Co(II) + H_2O_2 \rightarrow 2Co(III) + 2OH^-$ (c) $Co(III) + Col.\text{-}Dev. \rightarrow Col.\text{-}Dev._{\underline{ox}} + Co(II)$ (d) $Col.\text{-}Dev._{\underline{ox}} + Coupler \rightarrow Dye$

EXAMPLE 5

A Combined Mode — Using a Chelating Agent in the Developer

Figure 6:
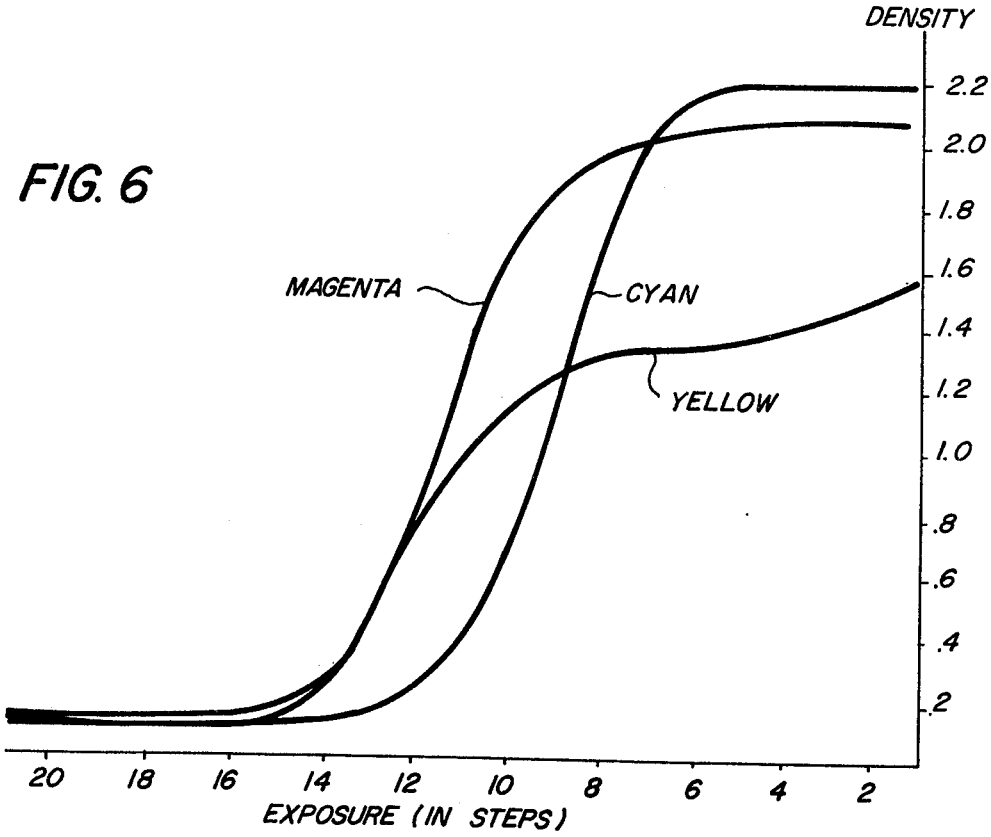

A. Using a sample of a photographic element identical to that of 1-A, the procedure of paragraph 4-D was repeated, but with the modification that 10 g of sodium ethylenediaminetetraacetic acid were added to the black-and-white developer bath Kodak D-19 employed. The results on the dye-image characteristic curves is shown in FIG. 6. By comparing FIGS. 5 and 6, it is apparent that the inclusion of the immobile ligand-forming sodium ethylenediaminetetraacetic aciid chelating agent in the black-and-white developer significantly improved dye-image densities.

EXAMPLE 6

A MONOBATH MODE

A. A photographic element was prepared similar to that of paragraph 1-A, except that different concentrations of ingredients were employed and a black-and-white developing agent, 4-hydroxymethyl-4-methyl-1-phenyl-3-pyrazolidone (MOP), was added to the blue-sensitive layer. The concentrations are set out below in Table X.

Table X

| Photographic Element 6-A |
|---|
| Gelatin (100) |
| Red-Sensitive Layer: Red-Sensitized Silver Halide (24); Gelatin (90); Coupler (35); Coupler Solvent (17.5) |
| Gelatin (160); 3,5-Di-tert-octylhydroquinone (4.5) |
| Green-Sensitive Layer: Green-Sensitized Silver Halide (10); Gelatin (132); Coupler (25); Coupler Solvent (15) |
| Gelatin (100); 3,5-Di-tert-octylhydroquinone (5.0) |
| Blue-Sensitive Layer: Silver Halide (16); Gelatin (122); Coupler (75); Coupler Solvent (19); MOP (10) |
| Paper Support |

B. A sample of the photographic element was exposed as in paragraph 1-B and immersed for 3 minutes in a monobath of the composition set forth in Table XI, of a type disclosed in my copending patent application U.S. Ser. No. 402,432, cited above.

Table XI

| Monobath Lacking Peroxide | |
|---|---|
| $Na_2SO_3$ | 2.0 g |
| Col.-Dev. Agent (CDA-1) | 10.0 g |
| $Na_2CO_3$ | 30.0 g |
| $Na_2S_2O_3$ | 20.0 g |
| $[Co(NH_3)_6]Ac_3$ | 20.0 g |
| Water to 1 liter (pH 12.5) | |

After processing in the monobath, the sample was washed with water for 1 minute, immersed in an aqueous 1% acetic acid stop bath for 1 minutes, washed with water again for minute and allowed to dry.

Figure 7:
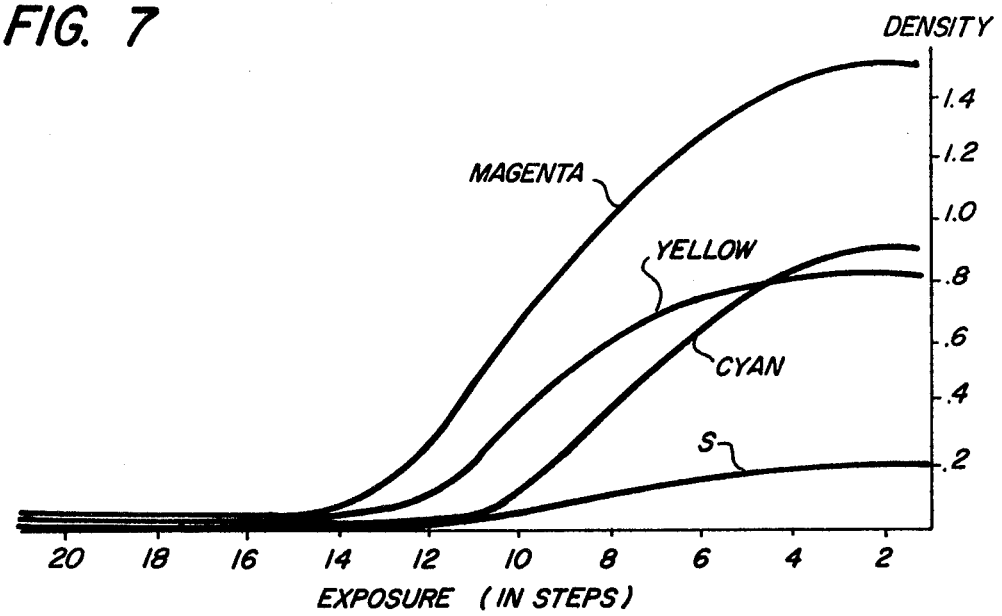
FIGS. 7 and8 are each similar to FIG. 4 and each additionally includes a plot of a silver image characteristic curve for the red light-recording layer.

The sample produced cyan, magenta and yellow dye images. The characteristic curves for the dye images are shown in FIG. 7. The infrared density of the silver image in the blue sensitive layer was also observed, and the characteristic curve of the silver image is shown as curve S in FIG. 7. It is apparent from curve S that some silver was retained in the sample being processed.

Figure 8:
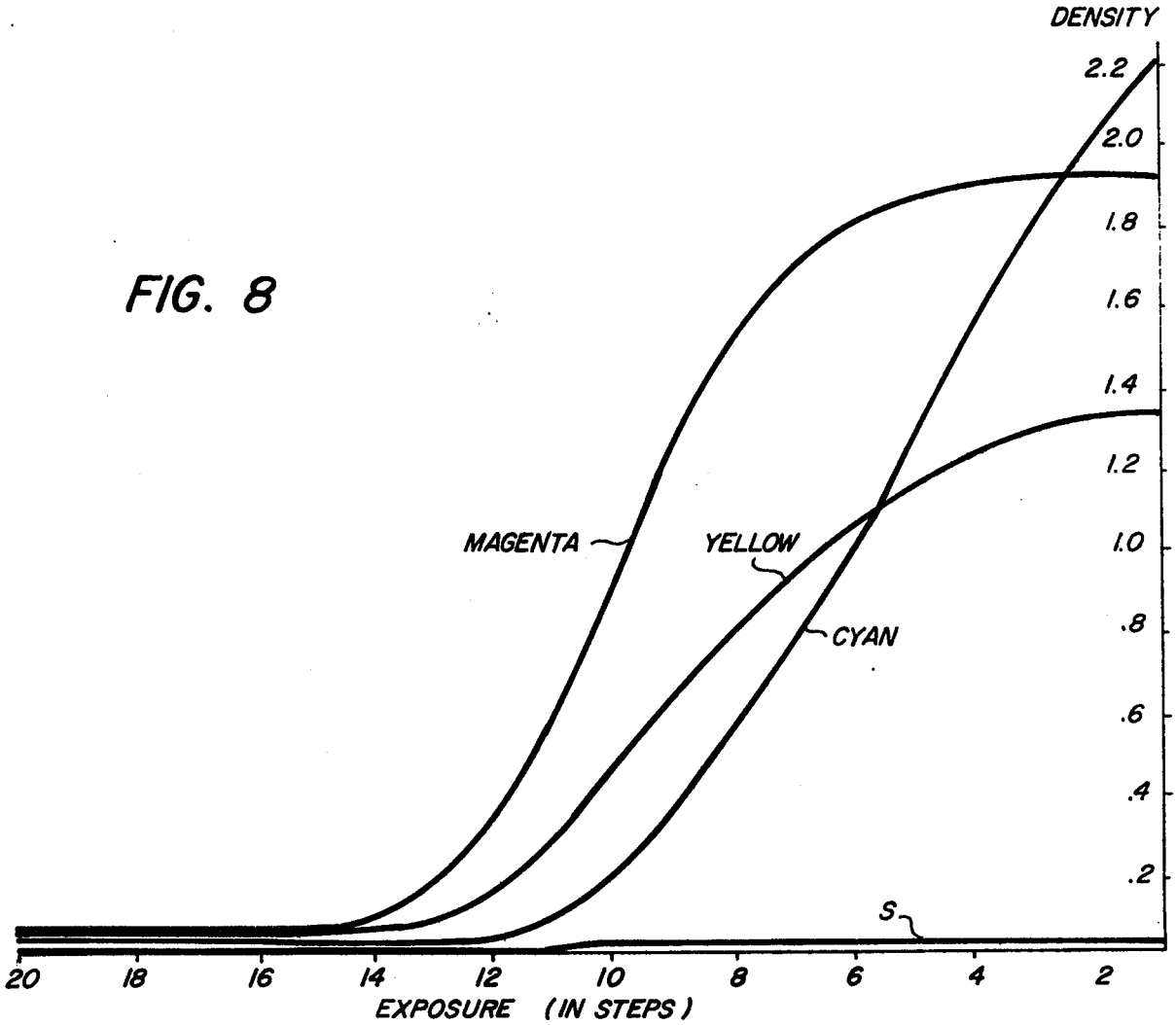

C. Using an identical second sample of the photographic element of paragraph 6-A, the process of paragraph 6-B was repeated, except that the composition of the monobath was modified by the addition of 1 ml of a 30% by weight aqueous solution of hydrogen peroxide. The result is shown in FIG. 8. Enhanced dye-image densities were obtained in each instance, and the silver image, represented by curve S, was substantially horizontal, indicating that the silver image was completely bleached.

It is believed that image-dye formation can be accounted for by the following principal reactions. Other reactions may be concurrently taking place.

(a) $B+W\ Dev. + exp.\ Agx \rightarrow Ag^{\circ} + B+W\ Dev._{\underline{ox}} + X^-$ (b) $2[Co(NH_3)_6]^{+3} + COL\text{-}DEV \xrightarrow{Ag^0} 2Co^{+2} + 12NH_3 + COl\text{-}DEV_{\underline{ox}}$ (c) $COL\text{-}DEV_{\underline{ox}} + Coupler\ DYE$ (d) $Ag^{\circ} + [Co(NH_3)_6]^{+3} + 2(S_2O_3)^{-2} \rightarrow Co^{+2} + Ag(S_2O_3)_2^{-1} + 6NH_3$ (e) $H_2O_2 + 2Co^{+2} \rightarrow 2Co^{+3} + 2OH^-$ (f) $Co^{+3} + COL\text{-}DEV \rightarrow COL\text{-}DEV_{\underline{ox}} + Co^{+2}$ (g) $COL\text{-}DEV_{\underline{ox}} + Coupler \rightarrow DYE$

EXAMPLE 7

A Color Image Transfer Application Employing Redox Dye-Releasers

A. A color image transfer photographic element having a film support and, coated thereon, a mordant layer, a reflective layer and a gelatino-silver halide emulsion layer, was prepared. The layers were of the composition set forth in Table X.

Table X

| Color Image Transfer Photographic Element 7-A |
|---|
| Gelatino-Silver Halide Emulsion Layer: Silver Halide (10); Magenta Redox Dye Releaser* (60); Gelatin (200) |
| Reflective Layer: Titanium Dioxide (2000); Gelatin (300) |
| Mordant Layer: Poly[styrene-co methyl-N-vinyl benzyl-co-divinyl benzene]latex (200); Gelatin (200) |
| Transparent Poly(Ethylene Terephthalate) Film Support |

*

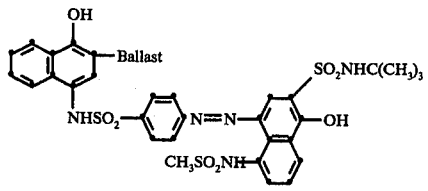

B. A first sample of the photographic element was exposed with a white light source through a graduated-density test object having 21 equal density steps ranging from 0 density at Step 1 to density of 6.0 at Step 21. The sample was then immersed for 10 seconds in a development bath of the composition set forth in Table XI.

Table XI

| Developer | |
|---|---|
| $Na_2SO_3$ | 10.0 g |
| p-Methylaminophenol sulfate | 2.0 g |
| $Na_2Co_3$ | 20.0 g |
| KBr | 2.0 g |
| Water to 1 liter (pH 11.5) | |

The sample containing a developed silver image was then immersed for 60 seconds in a blank bleach-fix and amplification bath comprised of the ingredients set forth in Table XII.

Table XII

| Blank Bleach-Fix and Amplification Bath | |
|---|---|
| $Na_2SO_3$ | 5.0 g |
| $Na_2CO_3$ | 20.0 g |
| $Na_2S_2O_3$ | 80.0 g |
| 11-Aminoundecanoic acid | 2.0 g |
| Diaminopropanol tetraacetic acid | |
| Water to 1 liter (pH 11.5) | |

Figure 9:
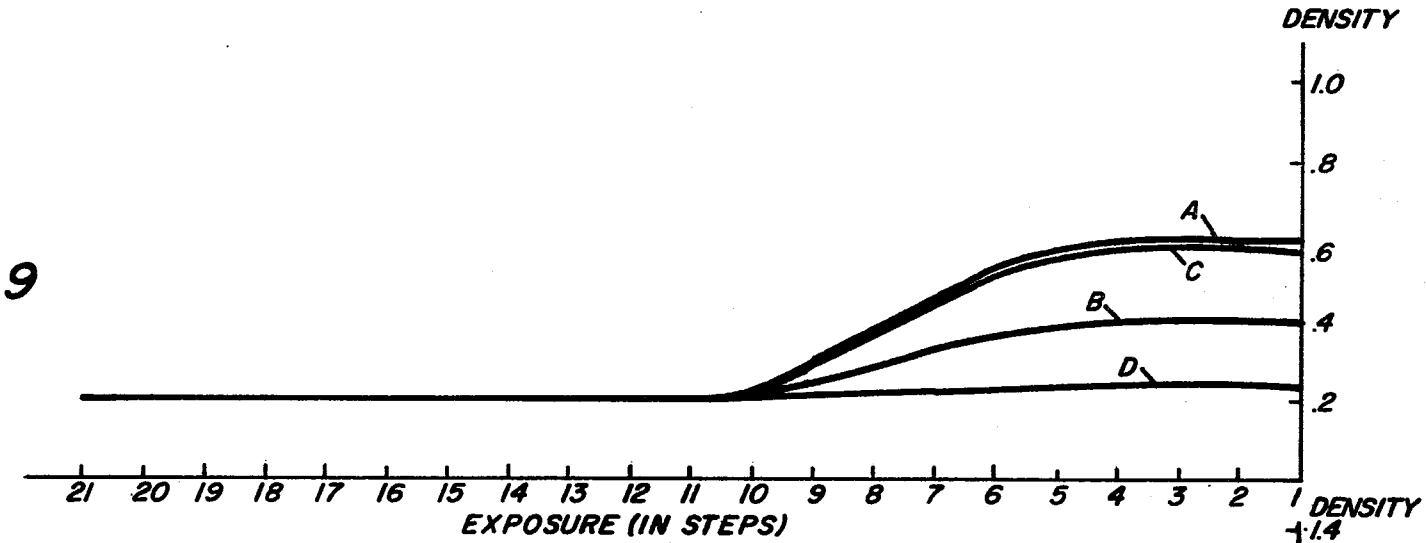
FIG. 9 is a plot of four silver image characteristic curves.
Figure 10:
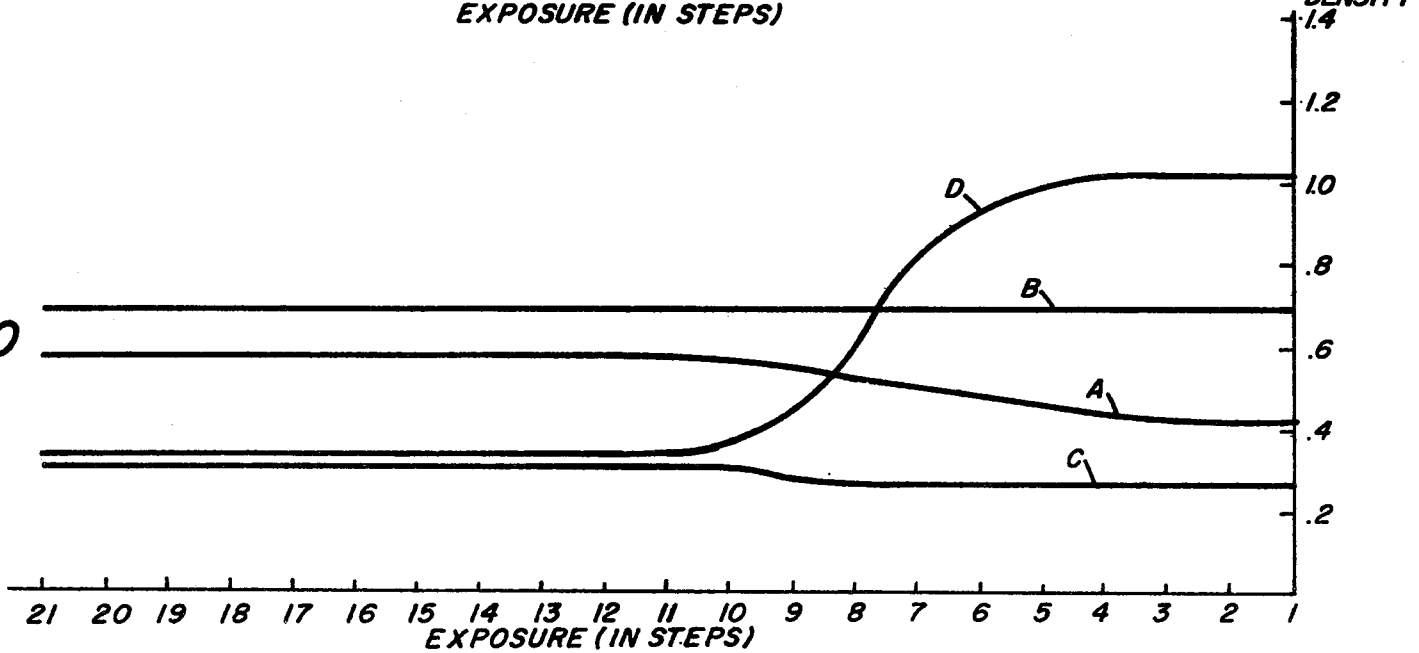
FIG. 10 is a plot of four cyan dye image characteristic curves corresponding to the silver image characteristic curves of FIG. 9.

Upon removal from the blank bleach-fix and amplification bath, a piece of poly(ethylene terephthalate) film support was laid over the emulsion layer to serve as a cover sheet. After 3 minutes the cover sheet was removed and the processed sample was washed and dried. Characteristic Curve A in FIG. 9 shows that a silver image was produced in the photosensitive layer. Curve A in FIG. 10 shows that no dye image was produced in the mordant layer. The presence of the silver image and the absence of a dye image was to be expected, since there was no bleaching agent present in the blank bleach-fix and amplification bath and an insufficient amount of exposed siliver halide to produce a significant amount of diffusible dye.

C. The procedure of paragraph 7-B was repeated with a second sample of the photographic element, except that 1.0 gram per liter of cobalt hexammine acetate was added to the blank bleach-fix and amplification bath. Some of the silver image was bleached, as is illustrated by Curve B in FIG. 9; but no transferred dye image was obtained, as is illustrated by Curve B in FIG. 10.

D. The procedure of paragraph 7-B was repeated with a third sample of the photographic element, except that 10.0 ml liter of 30 percent by weight hydrogen peroxide in water was added to the developer solution. As is illustrated in FIG. 9 by curve C, the silver image was not bleached and no transferred dye image was obtained, as is indicated by Curve C in FIG. 10.

E. The procedure of paragraph 7-B was repeated with a fourth sample of the photographic element, except that 10.0 ml per liter of 30 percent by weight hydrogen peroxide in water and 1.0 gram per liter of cobalt hexamine acetate were added to the blank bleach-fix and amplification bath. Essentially no silver image could be seen, as indicated by Curve D in FIG. 9. The lack of image silver is attributed to the bleaching activity of the bath. A transferred dye image was obtained, as is illustrated by Curve D in FIG. 10.

EXAMPLE 8

A Method of Forming Dye Images By Redox Amplification Particularly Useful With Coarse Grain Silver Halide Emulsions A. A photographic element having a transparent film support was formed by coating thereon a silver halide emulsion layer of the composition set forth below in Table XIII.

Table XIII

| Photographic Element |
|---|
| Gelatino-Silver Halide Emulsion Layer: Silver Bromide (1) (mean grain diameter 0.8 μ); Coupler 2-[α-(2,4-di-tert-amylphenoxy)butyramido]-4,6-dichloro-5-methylphenol (100); Gelatin (300) |
| Film Support |

B. A first sample of the photographic element was exposed with a white light source through a graduated-density test object having 21 equal density steps ranging from 0 density at Step 1 to a density of 6.0 at Step 21. The sample was then immersed for 1 minute in a development bath of the composition set forth in Table XIV maintained at 24° C.

Table XIV

| Black-and-White Developer | |
|---|---|
| $Na_2SO_3$ | 75.0 g |
| p-Methylaminophenol sulfate | 2.0 g |
| Hydroquinone | 8.0 g |
| $Na_2CO_3$ | 52.5 g |
| KBr | 5.0 g |
| Water to 1 liter. | |

The sample was then immersed in fix bath of the composition set forth in Table XV for 1 minute.

Table XV

| Fix Bath | |
|---|---|
| $Na_2S_2O_3$ | 240.0 g |
| $Na_2SO_3$ | 15.0 g |

Table XV-continued

| Fix Bath | |
|---|---|
| Acetic Acid (28% by wt.) | 48.0 cc |
| Boric Acid, crystals | 7.5 g |
| Potassium Alum | 15.0 g |
| Water to 1 liter. | |

The sample was then placed in a preamplification bath of the composition set forth below in Table XVI.

Table XVI

| Preamplification Bath | |
|---|---|
| Water | 900 ml |
| NaOH (25% by wt.) | 20 ml |
| Cobalt chloropentammine chloride | 4.0 g |
| Water to 1 liter (pH 4, adjusted with acetic acid) | |

The sample was then washed for 3 minutes with water and immersed for 4 minutes in an amplification bath of the composition set forth in Table XVII.

Table XVII

| Amplification Bath | |
|---|---|
| $Na_2SO_3$ | 2.0 g |
| Color Developing Agent CDA-1 | 5.0 g |
| $Na_2CO_3$ | 20.0 g |
| KBr | 0.025 g |
| $H_2O_2$(30% by wt.) | 5.0 ml |
| Water to 1 liter (ph 10.3). | |

Figure 11:
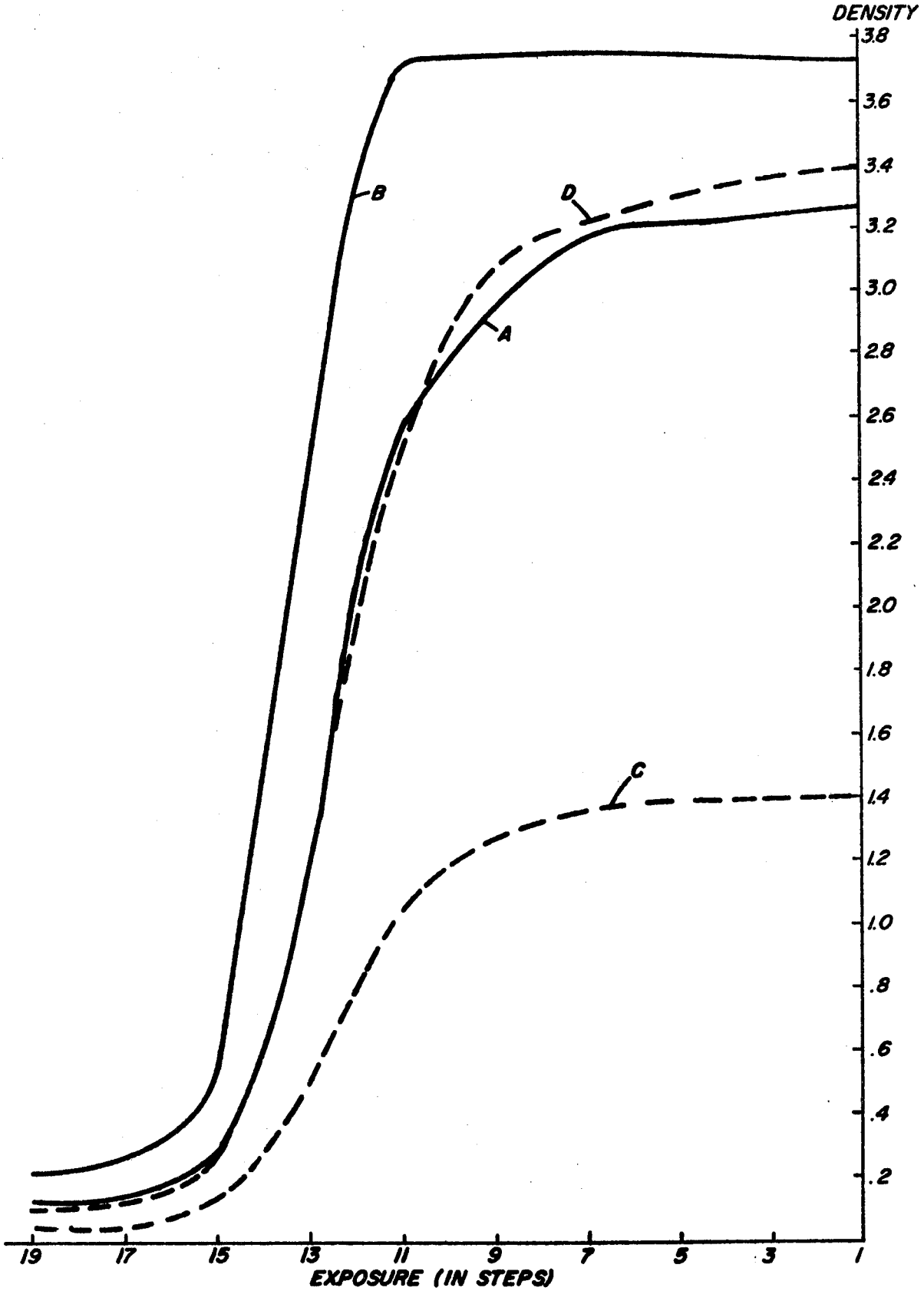
FIG. 11 is a plot of four cyan dye image characteristic curves.

The sample was then placed in a stop bath of dilute acetic acid for 1 minute and then washed in water for 2 minutes. The dye image obtained is shown as Curve A in FIG. 11.

C. A second sample of the photographic element was identically exposed and processed as in paragraph 8-B, except that the sample remained in the amplification bath for 8 minutes. The dye image is shown as Curve B in FIG. 11.

D. A third sample of the photographic element was identically exposed and processed as in paragraph 8-B, except that the preamplification bath contained in place of cobalt chloropentammine chloride 4.0 grams of cobalt aquopentammine nitrate and 5.0 grams of sodium chloride. The dye image is shown as Curve C in FIG. 11.

E. A forth sample of the photographic element was identically exposed and processed as in paragraph 8-D, except that the sample was left in the amplification bath for 8 minutes. The dye image is shown as Curve D in FIG. 11. When ferric chloride is employed in place of cobalt chloropentammine, is provides similar dye images.

The invention has been described in detail with reference to certain preferred embodiments thereof, but it will be understood that variations and modifications can be effected within the spirit and scope of the invention.

What is claimed is:

1. A method of forming an image comprising fixing silver halide and concurrently bleaching at least a portion of a silver image contained within a silver halide photographic element by reacting therewith, in the presence of a silver salt-forming compound which is incapable of oxidizing image silver, a cobalt(III) complex which permanently releases ligands upon reduction, while concurrently producing cobalt(II) as an immobile reaction product in a pattern conforming to the silver image pattern and forming a dye image by (1) reacting a peroxide oxidizing agent with the cobalt(II) reaction product to form a cationic cobalt(III) oxidizing agent as a reaction product in a pattern conforming to the silver image pattern and (2) reacting with the cationic cobalt(III) oxidizing agent a dye-image-generating reducing agent, wherein the peroxide oxidizing agent and the dye-image-generating reducing agent are essentially inert to oxidation-reduction in the absence of the cobalt(II) reaction product and the fixing-bleaching and dye image forming steps are each performed using an aqueous alkaline processing solution.

2. A method according to claim 1 wherein a single aqueous alkaline processing solution is employed in performing both the bleach-fix and dye image forming steps and the cobalt(III) complex and the dye-image-generating reducing agent are inert to oxidation-reduction in the absence of a catalyst.

3. A method according to claim 2 wherein the aqueous alkaline solution employed in each of the bleach-fix and dye image forming steps is sufficiently alkaline to immobilize substantially completely the cobalt(II) reaction product.

4. A method according to claim 2 wherein the aqueous alkaline processing solution employed in each of the bleach-fix and dye image forming steps exhibits a pH of at least 10.

5. A method of forming an image comprising in a first aqueous alkaline processing solution, bleaching at least a portion of a silver image contained within a photographic element by reacting therewith, in the presence of a silver salt-forming compound which is incapable of oxidizing image silver, a cobalt(III) complex which permanently releases ligands upon reduction, while concurrently producing cobalt(II) as an immobile reaction product in a pattern conforming to the silver image pattern and in a second aqueous alkaline processing solution, forming a dye image by (1) reacting a peroxide oxidizing agent with the cobalt(II) reaction product to form a cationic cobalt(III) oxidizing agnet as a reaction product in a pattern conforming to the silver image pattern and (2) reacting with the cationic cobalt(III) oxidizing agent a dye-image-generating reducing agent, wherein the peroxide oxidizing agent and the dye-image-generating reducing agent are essentially inert to oxidation-reduction in the absence of the cobalt(II) reaction product and the bleaching and dye image forming steps are each performed using an aqueous alkaline processing solution.

6. A method according to claim 5 wherein a peroxide oxidizing agent is additionally incorporated within the aqueous alkaline solution employed in the bleaching step.

7. A method according to claim 1 wherein the cobalt(III) complex contains monodentate and/or bidentate ligands.

8. A method according to claim 7 wherein the cobalt(III) complex is incorporated in the aqueous alkaline solution employed in the bleach-fix step.

9. A method according to claim 1 wherein the silver salt-forming compound which is incapable of oxidizing image silver is a silver halide solvent.

10. A method according to claim 9 wherein the silver halide solvent is incorporated in the aqueous alkaline solution employed in the dye image forming step.

11. A method according to claim 1 wherein the dye-image-generating reducing agent is comprised of a color-developing agent which, in its oxidized form, is capable of reacting with a color coupler to form a dye.

12. A method according to claim 1 wherein the color-developing agent is incorporated in an aqueous alkaline solution employed in the dye image forming step and the color coupler is incorporated in the photographic element being processed.

13. A method according to claim 1 wherein the dye-image-generating reducing agent is comprised of a redox dye-releaser.

14. A method of forming an image comprising, in a common aqueous alkaline processing solution, developing to produce a silver image, an imagewise-exposed photographic element comprised of a support and at least one radiation-sensitive silver halide layer containing a developable latent image therein, bleaching at least a portion of a silver image contained within the photographic element by reacting therewith, in the presence of a silver salt-forming compound which is incapable of oxidizing image silver, a cobalt(III) complex which permanently releases ligands upon reduction, while concurrently producing cobalt(II) as an immobile reaction product in a pattern conforming to the silver image pattern and forming a dye image by (1) reacting a peroxide oxidizing agent with the cobalt(II) reaction product to form a cationic cobalt(III) oxidizing agent as a reaction product in a pattern conforming to the silver image pattern and (2) reacting with the cationic cobalt(III) oxidizing agent a dye-image-generating reducing agent, wherein, the peroxide oxidizing agent and the dye-image-generating reducing agent are essentially inert to oxidation-reduction in the absence of the cobalt(II) reaction product and the cobalt(III) complex and the dye-image-generating reducing agent are essentially inert to oxidation-reduction in the absence of a redox catalyst.

15. A method according to claim 14 wherein a black-and-white developing agent is employed to produce a silver image.

16. A method according to claim 15 wherein the black-and-white developing agent is initially incorporated within the photographic element.

17. A method according to claim 14 wherein the silver halide within the photographic element is fixed.

18. A method according to claim 17 wherein the silver halide within the photographic element is fixed concurrently with bleaching.

19. A method according to claim 17 wherein the silver halide within the photographic element is fixed after the dye image forming step is completed.

20. A method according to claim 14 wherein the dye-image-generating reducing agent is incorporated in the photographic element and is a redox dye-releaser.

21. A method of forming a image comprising bringing a photographic element comprised of a support and at least one radiation-sensitive silver halide layer bearing a latent image into contact with an aqueous alkaline solution containing less than a 0.05 molar concentration of any compound which will form a tridentate or higher dentate ligand with cobalt, comprising a silver salt-forming compound which is incapable of oxidizing image silver and a peroxide oxidizing agent, at least one of the photographic element and the solution containing a coablt(III) complex which permanently releases ligands upon reduction, a silver halide developing agent and a dye-image-generating reducing agent, so that a dye image can be formed conforming to the latent image pattern originally present, wherein the peroxide oxidizing agent, the cobalt(III) complex, the silver halide developing agent and the dye-image-generating reducing agent are essentially inert to oxidation-reduction in the absence of a catalyst.

22. A method according to claim 21 wherein the cobalt(III) complex has a coordination number of 6 and contains at least 4 ammine ligands.

23. A method according to claim 22 wherein the cobalt(III) complex is a cobalt hexammine complex.

24. A method according to claim 21 wherein the silver salt-forming compound is a silver halide solvent.

25. A method according to claim 24 wherein the silver salt-forming compound is a thiosulfate silver halide solvent.

26. A method according to claim 21 wherein the peroxide oxidizing agent is water-soluble.

27. A method according to claim 26 wherein the peroxide oxidizing agent is hydrogen peroxide.

28. A method according to claim 21 wherein the dye-image-generating reducing agent is comprised of a primary aromatic amine developing agent and the photographic element includes incorporated therein at least one photographic color coupler.

29. A method according to claim 21 wherein the aqueous solution has a pH of at least 10.

30. A method of forming an image comprising bringing a photographic element comprised of a support and at least one radiation-sensitive silver halide layer containing a developable latent image into contact with an aqueous alkaline developer solution, wherein at least one of the photographic element and the developer solution contain a silver halide developing agent, so that a silver image is formed in the photographic element corresponding to the developable latent image, poisoning the silver image as a redox amplification catalyst for a peroxide oxidizing agent, bringing the photographic element bearing the silver image into contact with an aqueous alkaline bleaching solution containing less than a 0.05 molar concentration of any compound which will form a tridentate or higher dentate ligand with cobalt and comprising a silver salt former which is incapable of oxidizing image silver, at least one of the photographic element and the bleaching solution containing a cobalt(III) complex which permanently releases ligands upon reduction, thereby converting at least a portion of the silver image to a silver salt and producing cobalt(II) as an immobile reaction product within the silver image pattern, and thereafter bringing the photographic element into contact with an aqueous alkaline amplification solution, separate from the aqueous alkaline bleaching solution, comprising a peroxide oxidizing agent capable of reacting with the cobalt(II) reaction product to form a cationic cobalt(III) oxidizing agent as a reaction product in a pattern conforming to the silver image pattern, at least one of the photographic element and the amplification solution containing a dye-image-generating reducing agent capable of entering into a redox reaction with the cobalt(III) oxidizing agent so that a dye image can be formed, wherein the peroxide oxidizing agent and the dye-image-generating reducing agent are essentially inert to oxidation-reduction in the absence of the cobalt(II) reaction product formed by bringing the photographic element into contact with the aqueous alkaline bleaching solution and formation of the dye image employs the cobalt(II) reaction product as a catalyst for the reaction of the peroxide oxidizing agent and the dye-image-generating reducing agent.

31. A method according to claim 30 wherein the developing agent is a black-and-white developing agent incorporated initially within the photographic element.

32. A method according to claim 31 wherein the dye-image-generating reducing agent is a color-developing agent contained within the aqueous alkaline amplification solution and the photographic element contains at least one color coupler.

33. A method according to claim 30 wherein the steps of developing and bleaching are performed using a single aqueous alkaline processing solution having a pH of at least 10, and the silver halide developing agent and the cobalt(III) complex are essentially inert to oxidation-reduction in the absence of a catalyst.

34. A method according to claim 33 wherein the steps of developing, bleaching and amplification are performed using a single aqueous alkaline processing solution having a pH of at least 10.

35. A method of forming an image comprising bringing a photographic element comprised of a support bearing a silver image thereon into contact with an aqueous alkaline bleaching and fixing solution having a pH in the range of from 10 to 30 containing less than a 0.05 molar concentration of any compound which will form a tridentate or higher dentate ligand with cobalt, and comprising a silver halide fixing concentration of at least one of an alkali or ammonium bromide, chloride or thiosulfate, at least one of the photographic element and the aqueous alkaline bleaching and fixing solution comprising a cobalt(III) complex bleaching agent having a coordination number of 6 and monodentate or bidentate ligands, at least four of the ligands being ammine ligands, so that silver halide is fixed and at least a portion of the silver image is bleached, and bringing the photographic element into contact with an aqueous alkaline amplification solution having a pH in the range of from 10 to 13 and containing a peroxide oxidizing agent, at least one of the photographic element and the amplification solution containing a color-developing agent and a photographic color coupler, wherein the peroxide oxidizing agent and the color-developing agent are essentially inert to oxidation-reduction in the absence of a catalyst, bleaching the silver image generates the catalyst and formation of a dye image occurs bringing the photographic element into contact with the amplification solution by employing the catalyst generated by bleaching.

36. A method according to claim 35 wherein the silver image is amplified by formation of the dye image.

37. A method according to claim 36 wherein the cobalt(III) complex is cobalt hexammine.

38. A method according to claim 36 wherein the aqueous alkaline bleaching solution contains a bromide or chloride ion concentration above about 0.08 mole per liter.

39. A method according to claim 38 wherein the aqueous alkaline bleaching solution contains a bromide ion concentration above about 0.40 mole per liter.

40. A method according to claim 36 wherein the thiosulfate is present in a concentration of from about 0.20 to 250 grams per liter.

41. A method according to claim 40 wherein the thiosulfate is sodium thiosulfate present in a concentration of from about 2 to 50 grams per liter.

42. A method according to claim 36 wherein the peroxide oxidizing agent is hydrogen peroxide present in a concentration of from about 0.001 to 0.5 mole per liter.

43. A method according to claim 36 wherein the aqueous alkaline bleaching solution contains hydrogen peroxide in a concentration of from about 0.001 to 0.5 mole per liter.

44. A method according to claim 36 wherein a single aqueous alkaline solution is employed as both a bleaching solution and an amplification solution and contains less than a 0.01 molar concentration of any compound which will form a tridentate or higher dentate ligand with cobalt and wherein the cobalt(III) complex and the dye-image-generating reducing agent are essentially inert to oxidation-reduction in the absence of a catalyst.

45. A method of forming an image comprising bringing a photographic element comprised of a support and at least one radiation-sensitive silver halide emulsion layer containing a developable latent image into contact with an aqueous alkaline developer solution having a pH in the range of from 10 to 13, wherein at least one of the photographic element and the developer solution contains a silver halide developing agent, so that a silver image is formed in the photographic element corresponding to the developable latent image, bringing the photographic element into contact with an aqueous alkaline bleaching and fixing solution having a pH in the range of from 10 to 13 containing less than a 0.05 molar concentration of any compound which will form a tridentate or higher dentate ligand with cobalt and comprising a silver halide fixing concentration of at least one of an alkali or ammonium bromide, chloride or thiosulfate, at least one of the photographic element and the aqueous alkaline bleaching and fixing solution comprising a cobalt(III) complex bleaching agent having a coordination number of 6 and monodentate or bidentate ligands, at least four of the ligands being ammine ligands, so that silver halide is fixed and at least a portion of the silver image is bleached, and bringing the photographic element into contact with an aqueous alkaline amplification solution having a pH in the range of from 10 to 13 and containing a peroxide oxidizing agent, at least one of the photographic element and the amplification solution containing a peroxide oxidizing agent, at least one of the photographic element and the amplification solution containing a primary aromatic amine and a photographic color coupler, wherein the peroxide oxidizing agent and the primary aromatic amine are essentially inert to oxidation-reduction in the absence of a catalyst, bleaching the silver image generates the catalyst and formation of a dye image occurs upon bringing the photographic element into contact with the amplification solution by employing the catalyst generated by bleaching.

46. A method according to claim 45 wherein the aqueous alkaline bleaching solution initially contains less than a 0.01 molar concentration of any compound which will form a tridentate or higher dentate ligand with cobalt.

47. A method according to claim 46 wherein the photographic element initially contains a pyrazolidone or hydroquinone developing agent and the photographic color coupler.

48. A method according to claim 47 wherein a single aqueous alkaline solution is employed as the aqueous alkaline developer, bleaching and amplification solutions and the cobalt(III) complex and each silver halide developing agent present are essentially inert to oxidation-reduction reaction in the absence of a catalyst.

49. A method according to claim 45 wherein separate aqueous alkaline developer and bleaching solutions are employed and the aqueous alkaline developer solution initially contains a compound capable of forming a tridentate or higher dentate ligand with cobalt.

50. A method of forming a multicolor dye image in a photographic element comprised of a support and, coated thereon, at least three layer units each comprised of at least one silver halide emulsion layer, each of said layer units being primarily responsive to a different one of the blue, green and red portions of the visible spectrum, the blue-sensitive layer unit containing a yellow-dye-forming color coupler, the green-sensitive layer unit containing a magenta-dye-forming color coupler and the red-sensitive layer unit containing a cyan-dye-forming color coupler, the silver halide emulsion layers each containing a latent image pattern therein resulting from imagewise exposure of the photographic element, comprising developing a silver image in each of the three layer units corresponding to the latent image pattern thereof, fixing silver halide and concurrently bleaching at least a portion of the silver image in each of the layer units with a cobalt(III) complex which permanently releases ligands upon reduction and a silver salt-forming compound which is incapable of oxidizing image silver, which produces cobalt(II) as an immobile reaction product in a pattern conforming to the silver image pattern, and forming a dye image in each of the three layer units by (1) reacting a peroxide oxidizing agent with the cobalt(II) reaction product to form a cationic cobalt(III) oxidizing agent as a reaction product in a pattern conforming to the silver image pattern and (2) reacting with the cationic cobalt(III) oxidizing agent a primary aromatic amine developing agent, wherein the peroxide oxidizing agent and the primary aromatic amine developing agent are essentially inert to oxidation-reduction in the absence of the cobalt(II) reaction product and developing, bleaching and dye image forming steps are each performed using an aqueous alkaline solution.

51. A method according to claim 50 wherein the silver image is bleached in any aqueous alkaline bleaching solution which contains less than a 0.05 molar concentration of any compound which will form a tridentate or higher dentate chelate with cobalt.

52. A method according to claim 51 wherein each layer unit contains from about 1.0 to 325 milligrams per square meter of silver halide.

53. A method according to claim 52 wherein each layer unit contains at least a 40% stoichiometric excess of the color coupler based on the weight of silver halide present.

54. A method according to claim 50 wherein the photographic element contains a black-and-white developing agent.

55. A method of forming a multicolor dye image in a photographic element comprised of a support and, coated thereon, at least three layer units each comprised of at least one gelatino-silver halide emulsion layer, each of said layer units being primarily responsive to a different one of the blue, green and red portions of the visible spectrum, the blue-sensitive layer unit containing an open-chain ketomethylene yellow-dye-forming color coupler, the green-sensitive layer unit containing a 5-pyrazolone magenta-dye-forming color coupler and the red-sensitive layer unit containing a phenolic cyan-dye-forming color coupler, and at least one of the layer units containing a developable latent image, comprising sequentially bringing th photographic element into contact with an aqueous alkaline developer solution having a pH in the range of from 10 to 13 wherein at least one of the photographic element and the developer solution contains at least one black-and-white silver halide developing agent, so that a silver image is formed in the photographic element corresponding to the developable latent image, bringing the photographic element into contact with a separate aqueous alkaline bleach-fix solution having a pH in the range of from 10 to 13 which is substantially free of any compound which will form a tridentate or higher dentate ligand with cobalt and comprising an alkali or ammonium bromide or thiosulfate, and at least one of the photographic element and the aqueous alkaline bleach-fix solution comprising cobalt hexammine, so that at least a portion of the silver image is bleached, and bringing the photographic element into contact with a separate aqueous alkaline amplification solution having a pH in the range of from 10 to 13 and containing hydrogen peroxide and a primary para-phenylenediamine color-developing agent, wherein the hydrogen peroxide and the primary para-phenylenediamine color developing agent are essentially inert to oxidation-reduction in the absence of a catalyst, to form a dye image in at least one of the three layer units with a dye image.

56. A method according to claim 5 wherein hydrogen peroxide is incorporated within the bleach-fix solution.

57. A method according to claim 55 wherein the thiosulfate is present in a concentration of at least about 2 grams per liter of the bleach-fix solution.

58. A method according to claim 55 wherein the bromide is present in a concentration of above about 0.40 mole, based on bromide ion, per liter of the bleach-fix solution.

59. A method according to claim 55 wherein the cobalt hexammine is present as cobalt hexammine acetate or chloride in a concentration of from about 0.2 to 20 grams per liter of the bleach-fix solution.

60. A method according to claim 55 wherein the developer solution contains ethylenediaminetetraacetic acid in a concentration of from 1 mg to 10 grams per liter of the developer solution.

61. A method according to claim 55 wherein the hydrogen peroxide is present in a concentration of from 0.001 to 0.5 mole per liter of the amplification solution.

62. A method according to claim 61 wherein the hydrogen peroxide is present in a concentration of from 0.001 to 0.5 liter of the bleach-fix solution.

63. A method of forming a multicolor dye image in a photographic element comprised of a support and, coated thereon, at least three layer units each comprised of at least one gelatino-silver halide emulsion layer, each of the layer units incorporating therein a silver image formed by exposure to a separate one of the blue, green and red thirds of the visible spectrum, the layer unit containing the silver image formed by exposure to the blue third of the visible spectrum containing an open-chain ketomethylene yellow-dye-forming color coupler, the layer unit containing the silver image formed by exposure to the green third of the visible spectrum containing a 5-pyrazolone magenta-dye-forming color coupler and the layer unit containing the silver image formed by exposure to the red third of the visible spectrum containing a phenolic cyan-dye-forming color coupler, comprising bringing the photographic element into contact with an aqueous alkaline bleach-fix solution having a pH in the range of from 10 to 13 which is substantially free of any compound which will form a tridentate or higher dentate ligand with cobalt and comprising at least about 2 grams per liter of an alkali thiosulfate and from 0.2 to 20 grams per liter of cobalt hexammine acetate or chloride to bleach the silver image and to fix the silver halide while concurrently forming a redox amplification catalyst in each layer unit conforming to the silver image and bringing the photographic element into contact with an aqueous alkaline amplification solution having a pH in the range of from 10 to 13 containing 0.001 to 0.5 mole per liter of hydrogen peroxide and 1 to 20 grams per liter of a primary para-phenylenedimaine color-developing agent, thereby forming a dye image in each layer unit.

64. A method of forming a multicolor dye image according to claim 63 wherein the same aqueous alkaline solution is employed as both the bleach-fix solution and the amplification solution.

65. A method of forming a multicolor dye image in a photograhic element comprised of a support and, coated thereon, at least three layer units each comprised of at least one gelatino-silver halide emulsion layer, each of said layer units being primarily responsive to a different one of the blue, green and red portions of the visible spectrum, the blue-sensitive layer unit containing an open-chain ketomethylene yellow-dye-forming color coupler, the green-sensitive layer unit containing a 5-pyrazolone magenta-dye-forming color coupler and the red-sensitive layer unit containing a phenolic cyan-dye-forming color coupler, and each of said layer units containing a developable latent image, comprising developing the latent image to form a corresponding silver image, bleaching the silver image siver image, concurrently forming a catalyst image corresponding to the silverimage, fixing the silver halide, and forming a dye image corresponding to the original latent image in each layer unit, the improvement wherein each of the developing, bleaching and dye image forming steps are performed by bringing the photographic element into contact with a monobath comprising an aqueous alkaline developer solution having a pH in the range of from 10 to 13 containing at least about 2 grams per liter of an alkali thiosulfate, 0.2 to 2 grams per liter of cobalt hexammine acetate or chloride, 0.001 to 0.5 mole per liter of hydrogen peroxide, and 1 to 20 grams per liter of a primary para-phenylenediamine color-developing agent.

66. A color diffusion transfer method comprising bleaching at least a portion of a silver image contained within a photographic element by reacting therewith in the presence of a silver salt-forming compound which is incapale of oxidizing image silver, a cobalt(III) complex which permanently releases ligands upon reduction while concurrently producing cobalt(II) as an immobile reaction product in a pattern conforming to the silver image pattern, forming a dye image corresponding to the silver image pattern by (1) reacting a peroxide oxidizing agent with the cobalt(II) reaction product to form a cationic cobalt(III) oxidizing agent as a reaction product in a pattern conforming to the silver image pattern, (2) reacting with the cationic cobalt(III) oxidizing agent a dye-image-generating reducing agent so that a mobile dye image is formed in a pattern conforming to the silver image pattern and transferring the dye image to a receiver for viewing, wherein the peroxide oxidizing agent and the dye-image-generating reducing agent are essentially inert to oxidation-reduction in the absence of a catalyst and the bleaching and dye image forming steps are each performed using an aqueous alkaline solution.

67. A color diffusion transfer method according to claim 66 wherein the steps of bleaching the silver image and forming a dye image are both performed by bringing an aqueous alkaline processing solution into contact with the photographic element and the cobalt(III) complex and the dye-image-generating reducing agent are essentially inert to oxidation-reduction in the absence of a catalyst.

68. A color diffusion transfer method according to claim 67 wherein the aqueous alkaline processing solution initially upon contact with the photographic element exhibits a pH of at least 10.

69. A color diffusion transfer method comprising developing to produce a silver image, an imagewise-exposed photographic element comprised of a support and at least one radiation-sensitive silver halide layer containing a developable latent image and a redox dye-releaser therein, bleaching at least a portion of a silver image contained within the photographic element by reacting therewith, in the presence of a silver salt-forming compound which is incapable of oxidizing image silver, a cobalt(III) complex which permanently releases ligands upon reduction while concurrently producing cobalt(II) as an immoble reaction product in a pattern conforming to the silver image pattern, forming a dye image corresponding to the silver image pattern by (1) reacting a peroxide oxidizing agent with the cobalt(II) reaction product to form a cationic cobalt(III) oxidizing agent as a reaction product in a pattern conforming to the silver image pattern, (2) reacting with the cationic cobalt(III) oxidizing agent a cross-oxidizing silver halide developing agent (3) reaction the oxidized silver halide developing agent with the redox dye-releaser so that a mobile dye is released in a pattern conforming to the silver image pattern and transferring the mobile dye to a receiver for viewing as a dye image, wherein the steps of developing to produce a silver image, bleaching the silver image and replacing the silver image with a dye image are all performed by bringing an aqueous alkaline processing solution into contact with the photographic element and the cobalt(III) complex, the peroxide oxidizing agent and the redox dye-releaser are essentially inert to oxidation-reaction in the absence of a catalyst.

70. A color diffusion transfer method according to claim 69 wherein the aqueous alkaline processing solution initially upon contact with the photographic element exhibits a pH in the range from 10 to 13.

71. A color diffusion transfer method comprising bringing into contact with at least one silver halide emulsion layer coated on a photographic support wherein the emulsion layer contains a developable latent image pattern and a uniformly distributed redox dye-releaser, an aqueous alkaline processing solution having a pH in the range of from 10 to 13 containing less than a 0.05 molar concentration of any compound which will form a tridentate or higher chelate with cobalt, a silver salt-forming compound which is incapable of oxidizing image silver, a cobalt(III) complex oxidizing agent which permanently releases ligands uon reduction, a peroxide oxidizing agent and a cross-oxidizing silver halide developing agent, wherein the redox dye-releaser, the developing agent and the oxidizing agents are chosen so that they are essentially inert to oxidation-reduction in the absence of a catalyst, and selectively transferring a mobile dye image from the emulsion layer to a receiver for viewing.

72. A method of forming an image comprising in a first aqueous alkaline processing solution, developing to produce a silver image, an imagewise-exposed photographic element comprised of a support and at least one radiation-sensitive silver halide layer containing a developable latent image therein, in a second aqueous alkaline processing solution, bleaching at least a portion of a silver image contained within the photographic element by reacting therewith, in the presence of a silver salt-forming compound which is incapable of oxidizing image silver, a cobalt(III) complex which permanently released ligands upon reduction, while concurrently producing cobalt(II) ligands upon reduction, while concurrently producing cobalt(II) as an immobile reaction product in a pattern conforming to the silver image pattern and in a third aqueous alkaline processing solution, forming a dye image by (1) reacting a peroxide oxidizing agent with the cobalt(II) reaction product to form a cationic cobalt(III) oxidizing agent as a reaction product in a pattern conforming to the silver image pattern and (2) reacting with the cationic cobalt(III) oxidizing agent a dye-image-generating reducing agent, wherein, the peroxide oxidizing agent and the dye-image-generating reducing agent are essentially inert to oxidation-reduction in the absence of the cobalt(II) reaction product.

* * * * *

UNITED STATES PATENT AND TRADEMARK OFFICE

CERTIFICATE OF CORRECTION

PATENT NO. : 4,088,486

DATED : May 9, 1978

INVENTOR(S) : Vernon L. Bissonette

It is certified that error appears in the above-identified patent and that said Letters Patent are hereby corrected as shown below:

Column 6, lines 16-17, "paraphenylenediamine" should read ---para-phenylenediamine---; lines 47-48, "developemnt" should read --development--. Column 8, line 37, "thiocyante" should read --thiocyanate--. Column 9, line 47, "oxygen $X^1$" should read --oxygen, $X^1$--; line 58, that part of the formula reading "$Ch_2$" should read --$CH_2$--; line 62, that part of the formula reading "$Ch_2$" should read --$CH_2$--; line 66, that part of the formula reading "$Ch_2$" should read --$CH_2$--; last line, that part of the formula reading "O-oxo" should read --9-oxo--. Column 10, line 1, that part of the formula reading "$Ch_2Ch_2$" should read --$CH_2CH_2$--; line 5, that part of the formula reading "$Ch_2$" should read --$CH_2$--; line 9, "$HO(CH_2Ch_2O)_2(CH_2CH_2S)_2Ch_2CH_2OH$" should read --$HO(CH_2CH_2O)_2(CH_2CH_2S)_2CH_2CH_2OH$; line 13, that part of the formula reading "$Ch_2Ch_2$" should read --$CH_2CH_2$--; line 17, "$HOCH_2Ch_2O(Ch_2CH_2S)_4Ch_2CH_2OCH_2Ch_2OH$" should read --$HOCH_2CH_2O(CH_2CH_2S)_4CH_2CH_2OCH_2CH_2OH$--; line 19, that part of the formula reading "dioxo" should read --dioxa--; lines 22-23, that part of the formula reading "$SCH_2Ch_2O)CH_2Ch_2S)_3CH_2Ch_2OH$" should read --$SCH_2CH_2O(CH_2CH_2S)_3CH_2CH_2OH$--; lines 26-27, that part of the formula reading "$Ch_2S)_2CH_2CH_2O(CH_2Ch_2$" should read --$CH_2S)_2CH_2CH_2O(CH_2CH_2$--; line 31, that part of the formula reading "$Ch_2$" should read --$CH_2$--; line 38, that part of the formula reading "$Ch_2Ch_2$" should read --$CH_2CH_2$--; line 45, that part of the for-

UNITED STATES PATENT AND TRADEMARK OFFICE

CERTIFICATE OF CORRECTION

PATENT NO. : 4,088,486

DATED : May 9, 1978

INVENTOR(S) : Vernon L. Bissonette

It is certified that error appears in the above-identified patent and that said Letters Patent are hereby corrected as shown below:

mula reading "$Ch_2$" should read --$CH_2$--. Column 14, lines 8-9, that part of the formula reading "hyroxyethylaniline" should read --hydroxyethylaniline--; line 61, "yellor" should read --yellow--. Column 15, line 5, after "1:3", --to-- should be inserted. Column 19, line 22, "When" should read --Where--. Column 21, line 12, "coable(II)" should read --cobalt(II)--. Column 25, line 55, "zero" should read --azo--; line 55, "axopyrazolone" should read --azopyrazolone--. Column 28, line 63, "ca" should read --can--. Column 29, line 56, "ca" should read --can--. Column 32, line 34, "bleachig" should read --bleaching--; line 42, "indicaing" should read --indicating--. Column 33, line 22, "aadded" should read --added--; line 26, "absorptiion" should read --absorption--. Column 34, line 65, "aqeueous" should read --aqueous--; last line, "-b" should be deleted. Column 35, line 47, "aciid" should read --acid--. Column 36, line 29, "minutes," should read --minute,--; line 30, "for minute" should read --for 1 minute--; line 54, "Agx" should read --AgX--; line 58, that part of the formula reading "COl" should read --COL--; line 60, after "Coupler", -- $\longrightarrow$ -- should be inserted. Column 37, line 56, in the right column of the table opposite "acid", --0.2 g-- should be inserted. Column 40, line 48, "agnet" should read --agent--.

Column 43, line 41, "30" should

UNITED STATES PATENT AND TRADEMARK OFFICE

CERTIFICATE OF CORRECTION

PATENT NO. : 4,088,486

DATED : May 9, 1978

INVENTOR(X) : Vernon L. Bissonette

It is certified that error appears in the above-identified patent and that said Letters Patent are hereby corrected as shown below:

read --13--; line 66, after "occurs", --upon-- should be inserted. Column 46, line 58, "5" should read --55--. Column 47, line 45, "para-phenylenedimaine" should read --para-phenylenediamine--; line 53, "photograhic" should read --photographic--; line 66, "siver image," should read --while--; last line, "silverimage" should read --silver image--. Column 48, line 9, "2" should read --20--; line 18, "incapale" should read --incapable--. Column 49, line 36, "uon" should read --upon--.

Signed and Sealed this

***Twenty-first* Day of *August 1979***

[SEAL]

*Attest:*

*Attesting Officer*

LUTRELLE F. PARKER

*Acting Commissioner of Patents and Trademarks*